US011377922B2

(12) United States Patent
Johnson et al.

(10) Patent No.: US 11,377,922 B2
(45) Date of Patent: Jul. 5, 2022

(54) STATIC ANNULAR SEALING SYSTEMS AND INTEGRATED MANAGED PRESSURE DRILLING RISER JOINTS FOR HARSH ENVIRONMENTS

(71) Applicant: AMERIFORGE GROUP INC., Houston, TX (US)

(72) Inventors: Austin Johnson, Houston, TX (US); Justin Fraczek, Spring, TX (US)

(73) Assignee: AMERIFORGE GROUP INC., Houston, TX (US)

( * ) Notice: Subject to any disclaimer, the term of this patent is extended or adjusted under 35 U.S.C. 154(b) by 0 days.

(21) Appl. No.: 17/244,078

(22) Filed: Apr. 29, 2021

(65) Prior Publication Data

US 2021/0246755 A1 Aug. 12, 2021

Related U.S. Application Data

(63) Continuation of application No. PCT/US2019/051245, filed on Sep. 16, 2019.
(Continued)

(51) Int. Cl.
*E21B 33/08* (2006.01)
*E21B 17/08* (2006.01)
(Continued)

(52) U.S. Cl.
CPC ..... *E21B 33/085* (2013.01); *E21B 17/085* (2013.01); *E21B 21/001* (2013.01); *E21B 33/064* (2013.01); *E21B 33/1208* (2013.01)

(58) Field of Classification Search
CPC .... E21B 17/085; E21B 21/001; E21B 33/035; E21B 33/064; E21B 33/08; E21B 33/085;
(Continued)

(56) References Cited

U.S. PATENT DOCUMENTS 3,561,723 A * 2/1971 Cugini ..... E21B 33/085 251/1.2
3,955,822 A 5/1976 Irby
(Continued)

FOREIGN PATENT DOCUMENTS

WO 2019118394 A1 6/2019
WO 2020081175 A1 4/2020
(Continued)

OTHER PUBLICATIONS

European Patent Office Extended European Search Report for EP 18888557.8 filed on May 28, 2020, dated Jun. 29, 2021.
(Continued)

*Primary Examiner* — James G Sayre
(74) *Attorney, Agent, or Firm* — Basil M. Angelo; Angelo IP

(57) ABSTRACT

A harsh environment integrated MPD riser joint includes a dynamic annular sealing system, a static annular sealing system disposed directly below the dynamic annular sealing system, and a flow spool, or equivalent thereof, disposed directly below the static annular sealing system. The dynamic annular sealing system may be a conventional ACD-type, RCD-type, or other conventional annular sealing system. The static annular sealing system may include one or more annular packer systems and one or more connection sealing elements that engage drill pipe during connection or non-rotation operations only. The dynamic annular sealing system may maintain annular pressure during drilling operations while the static annular sealing system is disengaged. The static annular sealing system may maintain annular pressure during connection operations while the dynamic annular sealing system is disengaged. Advantageously, the static annular sealing system is capable of withstanding jarring heaving action encountered in harsh environments.

19 Claims, 16 Drawing Sheets

Related U.S. Application Data

(60) Provisional application No. 62/754,915, filed on Nov. 2, 2018.

(51) Int. Cl.
*E21B 21/00* (2006.01)
*E21B 33/064* (2006.01)
*E21B 33/12* (2006.01)

(58) Field of Classification Search
CPC .... E21B 33/1208; E21B 33/122; E21B 34/04; E21B 43/10
See application file for complete search history.

(56) References Cited

U.S. PATENT DOCUMENTS

| | | | | |
|---|---|---|---|---|
| 9,939,097 | B2 | 4/2018 | Pendleton | |
| 10,024,310 | B2 | 7/2018 | Pendleton | |
| 10,577,878 | B2 | 3/2020 | Johnson et al. | |
| 10,590,721 | B2 | 3/2020 | Johnson et al. | |
| 10,655,410 | B2 | 5/2020 | Johnson et al. | |
| 10,995,573 | B2 | 5/2021 | Fraczek et al. | |
| 11,008,825 | B2 | 5/2021 | Fraczek et al. | |
| 2009/0152006 | A1 | 6/2009 | Leduc et al. | |
| 2010/0175882 | A1 | 7/2010 | Bailey et al. | |
| 2011/0024195 | A1 | 2/2011 | Hoyer et al. | |
| 2011/0253445 | A1 | 10/2011 | Hannegan et al. | |
| 2012/0217022 | A1 | 8/2012 | Michaud et al. | |
| 2012/0272764 | A1 | 11/2012 | Pendleton | |
| 2013/0105141 | A1 | 5/2013 | Bernard et al. | |
| 2013/0168578 | A1* | 7/2013 | Leuchtenberg | E21B 33/06 251/1.3 |
| 2014/0216751 | A1* | 8/2014 | Liezenberg | E21B 33/06 166/350 |
| 2014/0231075 | A1 | 8/2014 | Springett et al. | |
| 2014/0238686 | A1 | 8/2014 | Boyd | |
| 2014/0311735 | A1 | 10/2014 | Landrith et al. | |
| 2015/0144400 | A1 | 5/2015 | Leuchtenberg et al. | |
| 2015/0376972 | A1 | 12/2015 | Lock | |
| 2016/0010411 | A1 | 1/2016 | Al-Rabeh | |
| 2016/0186515 | A1* | 6/2016 | Gilmore | E21B 19/006 166/365 |
| 2016/0186908 | A1 | 6/2016 | Pendleton | |
| 2017/0009550 | A1 | 1/2017 | Leuchtenberg et al. | |
| 2017/0044857 | A1 | 2/2017 | Leuchtenberg | |
| 2017/0191333 | A1 | 7/2017 | Lewis et al. | |
| 2018/0258730 | A1* | 9/2018 | Grace | E21B 33/038 |
| 2019/0055791 | A1 | 2/2019 | Barela | |
| 2019/0120000 | A1 | 4/2019 | Santos | |
| 2019/0145203 | A1 | 5/2019 | Johnson et al. | |
| 2019/0145204 | A1 | 5/2019 | Johnson et al. | |
| 2019/0145205 | A1 | 5/2019 | Johnson et al. | |
| 2020/0300051 | A1 | 9/2020 | Johnson et al. | |
| 2020/0300052 | A1 | 9/2020 | Johnson et al. | |
| 2020/0362651 | A1 | 11/2020 | Fraczek et al. | |
| 2020/0362659 | A1 | 11/2020 | Fraczek et al. | |
| 2021/0207447 | A1 | 7/2021 | Fraczek et al. | |
| 2021/0230963 | A1 | 7/2021 | Johnson et al. | |
| 2021/0246754 | A1 | 8/2021 | Fraczek et al. | |
| 2021/0246755 | A1 | 8/2021 | Johnson et al. | |

FOREIGN PATENT DOCUMENTS

| | | | |
|---|---|---|---|
| WO | 2020091900 | A1 | 5/2020 |
| WO | PCTUS2020061178 | | 11/2020 |
| WO | WO2021150299 | | 11/2020 |

OTHER PUBLICATIONS

Johnson, Austin, Fraczek, Justin, and Anderson, Bo, Enhancing Technology Development Process Through Purpose-Built Testing and Training Facilities, Paper presented at the IADC/SPE Asia Pacific Drilling Technology Conference held in Bangkok, Thailand, Aug. 27-29, 2018, published as IADC/SPE-191038-MS by the Society of Petroleum Engineers.

Johnson, Austin, Nichols, Jess, Ameen, Kareem, and Fraczek, Justin, Simulated Drilling Testing of an Active Wellbore Sealing System on a Full-Scale Test Rig, Paper presented at the SPE/IADC Drilling International Conference and Exhibition held in the Hague, The Netherlands, Mar. 5-7, 2019, published as SPE/IADC-194079-MS by the Society of Petroleum Engineers.

Johnson, Austin, Sundaramoorthy, Saravanan, Piccolo, Brian, and Fraczek, Justin, Real Time Condition Monitoring of the Wellbore Seal through Hydraulic Fluid Analysis Using an Active Wellbore Sealing System during Manged Pressure Drilling, Paper presented at Offshore Technology Conference Asia held in Kuala Lumpur, Malaysia, Mar. 20-23, 2018, published as OTC-28436-MS by Offshore Technology Conference.

PCT International Search Report for PCT International Application PCT/US2018/064839, filed Dec. 11, 2018, dated Feb. 27, 2019.

PCT International Search Report of International Search Authority (USPTO) for PCT/US2020/061178, filed on Nov. 19, 2020, dated Feb. 9, 2021.

PCT Written Opinion of International Search Authority (USPTO) for PCT/US2020/061178, filed on Nov. 19, 2020, dated Feb. 9, 2021.

PCT Written Opinion of the International Search Authority for PCT International Application PCT/US2018/064839, filed Dec. 11, 2018, dated Feb. 27, 2019.

USPTO non-final office action issued in U.S. Appl. No. 16/896,612, filed Jun. 9, 2020, dated Aug. 31, 2021.

USPTO non-final office action issued in U.S. Appl. No. 16/896,625, filed Jun. 9, 2020, dated Aug. 31, 2021.

USPTO non-final office action issued in U.S. Appl. No. 17/233,082, filed Apr. 16, 2021, dated Sep. 1, 2021.

U.S. Appl. No. 17/233,082, filed Apr. 16, 2021, Austin Johnson.

PCT International Search Report of the International Searching Authority (USPTO) for PCT International Application PCT/US2019/051245 dated Nov. 19, 2019.

PCT International Search Report of the International Searching Authority (USPTO) for PCT International Application PCT/US2019/051234 dated Nov. 19, 2019.

PCT Written Opinion of the International Searching Authority (USPTO) for PCT International Application PCT/US2019/051234 dated Nov. 19, 2019.

PCT Written Opinion of the International Searching Authority (USPTO) for PCT International Application PCT/US2019/051245 dated Nov. 19, 2019.

Applicant's reply to non-final Office Action issued in U.S. Appl. No. 17/233,082, filed Apr. 16, 2021, submitted on Nov. 10, 2021.

USPTO Notice of Allowance issued in U.S. Appl. No. 16/896,612, filed Jun. 9, 2020, dated Feb. 1, 2022.

USPTO Notice of Allowance issued in U.S. Appl. No. 16/896,625, filed Jun. 9, 2020, dated Dec. 15, 2021.

USPTO Notice of Allowance issued in U.S. Appl. No. 17/233,082, filed Apr. 16, 2021, dated Feb. 8, 2022.

U.S. Appl. No. 62/597,601, filed Dec. 12, 2017, Justin Fraczek.

Applicant reply to USPTO non-final office action issued in U.S. Appl. No. 16/896,612, filed Jun. 6, 2020, submitted to the USPTO dated Nov. 10, 2021.

Applicant reply to USPTO non-final office action issued in U.S. Appl. No. 16/896,625, filed Jun. 9, 2020, submitted to the USPTO dated Nov. 10, 2021.

USPTO non-final office action issued in U.S. Appl. No. 17/244,078, filed Apr. 29, 2021, dated Jan. 13, 2022.

* cited by examiner

STATIC ANNULAR SEALING SYSTEMS AND INTEGRATED MANAGED PRESSURE DRILLING RISER JOINTS FOR HARSH ENVIRONMENTS

CROSS-REFERENCE TO RELATED APPLICATIONS

This application is a continuation of PCT International Application PCT/US2019/051245, filed on Sep. 16, 2019, which claims the benefit of, or priority to, U.S. Provisional Patent Application Ser. No. 62/754,915, filed on Nov. 2, 2018, all of which are hereby incorporated by reference in their entirety for all purposes.

BACKGROUND OF THE INVENTION

Conventional managed pressure drilling ("MPD") systems include an annular sealing system, a drill string isolation tool, and a flow spool, or equivalents thereof, that actively manage wellbore pressure during drilling and other operations.

The annular sealing system typically includes an active control device ("ACD"), a rotating control device ("RCD"), or other type of annular sealing system that seals the annulus surrounding the drill pipe while it is rotated. The annulus is encapsulated such that it is not exposed to the atmosphere.

The drill string isolation tool is disposed directly below the annular sealing system and includes an annular packer that encapsulates the well and maintains annular pressure when rotation has stopped and the annular sealing system, or components thereof, are being installed, serviced, removed, or otherwise disengaged.

The flow spool is disposed directly below the drill string isolation tool and, as part of the pressurized fluid return system, diverts fluids from below the annular seal to the surface. The flow spool is in fluid communication with a choke manifold, typically disposed on a platform of the drilling rig, that is in fluid communication with a mud-gas separator or other fluids processing system.

The pressure tight seal on the annulus allows for the precise control of wellbore pressure by manipulation of the choke settings of the choke manifold and the corresponding application of surface backpressure.

MPD systems are increasingly being used in deepwater and ultra-deepwater applications where the precise management of wellbore pressure is required for technical, environmental, and safety reasons. In below-tension-ring configurations, conventional MPD systems include an integrated MPD riser joint as part of the upper marine riser system. The upper marine riser system is substantially stationary with respect to the body of water in which it is disposed. The floating rig is typically moored for stability but is designed to heave with the body of water in which it is disposed to avoid flooding. A telescopic joint is typically disposed above the integrated MPD riser joint to accommodate the heaving motion of the body of water. However, in harsh environments, heave of the floating rig may exceed 25 feet of displacement in a relatively short period of time.

BRIEF SUMMARY OF THE INVENTION

According to one aspect of one or more embodiments of the present invention, a harsh environment integrated MPD riser joint includes a dynamic annular sealing system having an upper sealing element and a lower sealing element, a static annular sealing system disposed below the dynamic annular sealing system having an annular packer system and a connection sealing element disposed within the annular packer system, and a flow spool disposed below the static annular sealing system that diverts returning fluids to the surface. The dynamic annular sealing system maintains annular pressure during drilling operations while the static annular sealing system is disengaged. The static annular sealing system maintains annular pressure during connection operations while the dynamic annular sealing system is disengaged.

According to one aspect of one or more embodiments of the present invention, a harsh environment integrated MPD riser joint includes a dynamic annular sealing system having an upper sealing element and a lower sealing element, a static annular sealing system disposed below the dynamic annular sealing system having an upper annular packer system and an upper connection sealing element disposed within the upper annular packer system and a lower annular packer system and a lower connection sealing element disposed within the lower annular packer system, and a flow spool disposed below the static annular sealing system that diverts returning fluids to the surface. The dynamic annular sealing system maintains annular pressure during drilling operations while the static annular sealing system is disengaged. The static annular sealing system maintains annular pressure during connection operations while the dynamic annular sealing system is disengaged.

Other aspects of the present invention will be apparent from the following description and claims.

DETAILED DESCRIPTION OF THE INVENTION

Figure 1:
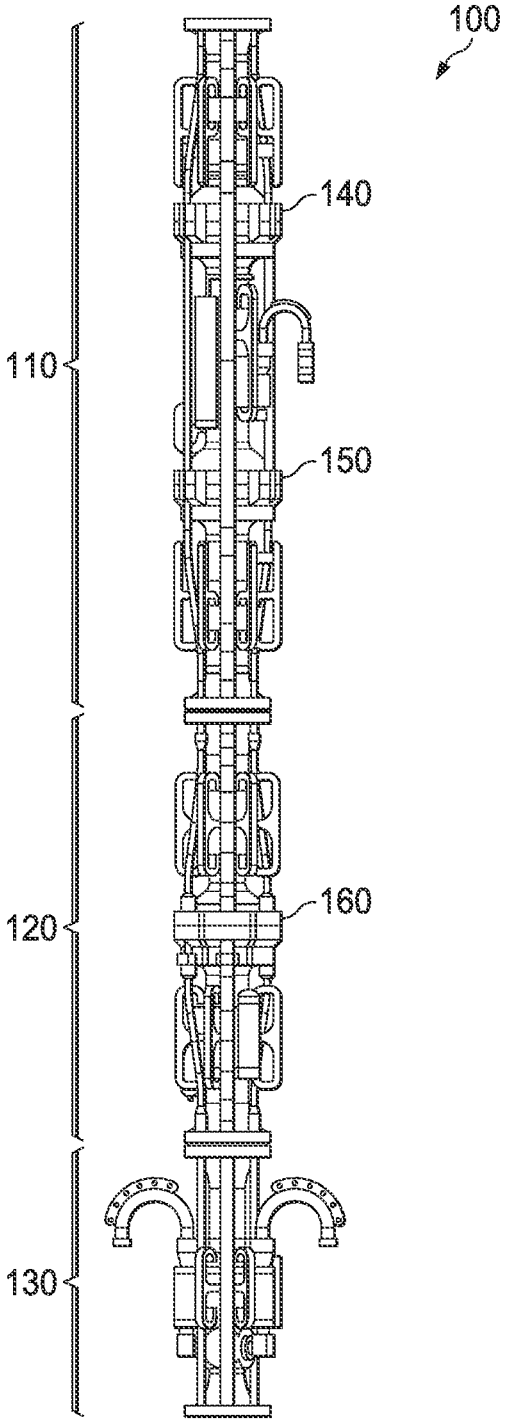
FIG. 1 PRIOR ART
FIG. 1 shows a conventional integrated MPD riser joint.

One or more embodiments of the present invention are described in detail with reference to the accompanying figures. For consistency, like elements in the various figures are denoted by like reference numerals. In the following detailed description of the present invention, specific details are set forth in order to provide a thorough understanding of the present invention. In other instances, well-known features to one of ordinary skill in the art are purposefully not described to avoid obscuring the description of the present invention.

In conventional below-tension-ring configurations, active heave compensation ("AHC") systems attempt to compensate for the heave of the body of water in which the floating rig is disposed. AHC systems seek to steady the weight-on-bit by isolating the motion of the floating rig from the motion of the drill pipe during drilling operations. An electric or hydraulic powered tension system is typically disposed on the floating rig and tensioners connect the rig to a tension ring attached to the outer barrel of the telescopic joint. As the body of water in which the floating rig heaves, the inner barrel of the telescopic joint reciprocates and the AHC system actively manages tension. The integrated MPD riser joint and portions of the marine riser system disposed below it remain substantially stationary despite the movement of the floating rig. During drilling operations, the heaving action of the harsh environment is compensated by the AHC system and the dynamic annular sealing system (ACD-type or RCD-type) of the conventional integrated MPD riser joint is effective at managing annular pressure.

However, AHC systems are not available during connections. When drill pipe is in slips during connections and other no-flow situations, applied surface backpressure is typically increased to offset the decrease in equivalent circulating density ("ECD"). With drill pipe in slips, tool joints that are not spaced out ideally are stripped through the sealing elements of the dynamic annular sealing system under increased applied surface backpressure. The total count of tool joints stripped during such connections may depend on the wave period, the spacing of tool joints, and the connection duration. In harsh environments, where the floating rig may be subjected to jarring heave in excess of 25 feet over a short period of time, tool joints are violently stripped through the sealing elements of the dynamic annular sealing system and the sealing elements, as well as the functionality of the dynamic annular sealing system itself, are prone to damage and ultimately failure.

In ACD-type dynamic annular sealing systems, the sealing elements remain stationary during rotation of the drill pipe. Each sealing element is typically composed of urethane co-molded with a polytetrafluoroethylene ("PTFE") cage that is engaged by the annular packer that cause the sealing element to squeeze on the drill pipe and form the annular seal. While the sealing elements of the ACD-type dynamic annular sealing system provide a number of advantages and are highly effective at maintaining annular pressure during drilling operations, they are prone to damage during connections that substantially shortens their effective life. Under high applied surface backpressure, such sealing elements typically require replacement within the stripping of approximately 400 tool joints at 1,000 pounds per square inch ("psi"). Replacing such sealing elements in harsh environments can be an expensive, time-consuming, and complex operation that results in substantial non-productive time. In addition, replacement may be dangerous, if possible at all, when the floating rig is subjected to jarring heave.

In RCD-type dynamic annular sealing systems, the sealing elements are disposed within a bearing such that the sealing elements rotate with the drill pipe. The sealing elements are typically elastomers that form an interference fit with the drill pipe while the bearings facilitate rotation of the sealing elements with the drill pipe. While the sealing elements of the RCD-type dynamic annular sealing system are effective at maintaining annular pressure during drilling operations, they are less effective during connections and are also prone to damage that substantially shortens their effective life. The stripping action encountered during connections exerts substantial side loads to the bearings. The side loading, and damage inflicted, is exacerbated by the harsh conditions and the number of tool joints stripped through. Replacing such sealing elements in harsh environments can be an expensive, time-consuming, and complex operation that results in substantial non-productive time. In addition, similar to the ACD-type dynamic annular sealing system, replacement may be dangerous, if possible at all, when the floating rig is subjected to jarring heave.

While the conventional integrated MPD riser joint includes a drill string isolation tool, or equivalent thereof, disposed below the dynamic annular sealing system, the drill string isolation tool, or equivalent thereof, includes an annular packer that is not capable of maintaining annular pressure during connections in harsh environments where a number of tool joints are stripped through as the floating rig heaves. As such, to safely and effectively engage in drilling operations in such harsh environments, an integrated MPD riser joint capable of maintaining annular pressure and withstanding the jarring stripping action encountered in harsh environments is needed.

Accordingly, in one or more embodiments of the present invention, a harsh environment integrated MPD riser joint includes a dynamic annular sealing system, a static annular sealing system disposed directly below the dynamic annular sealing system, and a flow spool, or equivalent thereof, disposed directly below the static annular sealing system. The dynamic annular sealing system may be a conventional ACD-type annular sealing system, conventional RCD-type annular sealing system, or other conventional annular sealing system. In certain embodiments, the static annular sealing system may include an annular packer system and a connection sealing element disposed within the annular packer system that engages drill pipe during connection operations. In other embodiments, the static annular sealing system may include an upper annular packer system and an upper connection sealing element disposed within the upper annular packer system and a lower annular packer system and a lower connection sealing element disposed within the lower annular packer system that engage drill pipe during connection operations. In still other embodiments, the static annular sealing system may include one or more annular packer systems and one or more connection sealing elements disposed within the corresponding annular packer systems that engage drill pipe during connection operations. The harsh environment integrated MPD riser joint may use the dynamic annular sealing system to maintain annular pressure during drilling operations while the static annular sealing system is disengaged. The static annular sealing system may maintain annular pressure during connection operations while the dynamic annular sealing system is disengaged. In certain embodiments, the connection sealing element may comprise polyurethane, nitrile rubber, or combinations thereof. In other embodiments, the connection sealing element may consist of polyurethane, nitrile rubber, or combinations thereof. Advantageously, the static annular sealing system is capable of withstanding jarring heaving action encountered in harsh environments.

FIG. 1 shows a conventional integrated MPD riser joint 100 configured for use as part of marine riser system (not shown). In offshore applications, a floating vessel (not shown), such as, for example, a semi-submersible, drillship, drill barge, or other floating rig or platform may be disposed over a body of water to facilitate drilling or other operations. A marine riser system (not independently illustrated) may provide fluid communication between the floating vessel (not shown) and a lower marine riser package ("LMRP") (not shown) or SSBOP (not shown) disposed on or near the ocean floor. The LMRP (not shown) or SSBOP are in fluid communication with the wellhead (not shown) of the wellbore (not shown). In below-tension-ring configurations (not shown) of an MPD system, a conventional integrated MPD riser joint 100 is disposed below the telescopic joint (not shown).

Conventional integrated MPD riser joint 100 includes an annular sealing system 110 disposed below a bottom distal end of the outer barrel (not shown) of the telescopic joint (not shown), a drill string isolation tool 120, or equivalent thereof, disposed directly below annular sealing system 110, and a flow spool 130, or equivalent thereof, disposed directly below drill string isolation tool 120. Annular sealing system 110 may be an ACD-type, RCD-type (not shown), or other type or kind of sealing system (not shown) that seals the annulus (not shown) surrounding the drill string or drill pipe (not shown) such that the annulus is encapsulated and not exposed to the atmosphere. In the ACD-type embodiment depicted, annular sealing system 110 includes an upper sealing element 140 (not shown, reference numeral depicting general location only) and a lower sealing element 150 (not shown, reference numeral depicting general location only) that seals the annulus surrounding the drill string or drill pipe (not shown). Upper sealing element 140 (not shown, reference numeral depicting general location only) and lower sealing element 150 (not shown, reference numeral depicting general location only) are typically attached to opposing ends of a mandrel and are collectively referred to as a dual seal sleeve. The sealing elements of the dual seal sleeve are typically engaged or disengaged at the same time. The redundant sealing mechanism extends the life of the sealing elements and increases the safety of operations.

Drill string isolation tool 120, or equivalent thereof, is disposed directly below annular sealing system 110 and provides an additional sealing element 160 (not shown, reference numeral depicting general location only) that encapsulates the well and seals the annulus surrounding the drill pipe when annular sealing system 110, or components thereof, are being installed, serviced, maintained, removed, or otherwise disengaged. For example, when sealing elements 140 (not shown, reference numeral depicting general location only) and 150 (not shown, reference numeral depicting general location only) require replacement while the marine riser is pressurized, such as, for example, during hole sections in between bit runs, drill string isolation tool 120 is engaged to maintain annular pressure while annular sealing system 110 is taken offline. To ensure the safety of operations, sealing element 160 (not shown, reference numeral depicting general location only) seals the annulus surrounding the drill pipe (not shown) while the sealing elements 140 (not shown, reference numeral depicting general location only) and 150 (not shown, reference numeral depicting general location only) of annular sealing system 110 are removed and replaced. Flow spool 130, or equivalents thereof, is disposed directly below drill string isolation tool 120 and, as part of the pressurized fluid return system, diverts fluids (not shown) from below the annular seal to the surface (not shown). Flow spool 130 is in fluid communication with a choke manifold (not shown), typically disposed on a platform of the floating rig (not shown), that is in fluid communication with a mud-gas separator (not shown) or other fluids processing system (not shown) disposed on the surface.

The pressure tight seal on the annulus provided by annular sealing system 110 allows for the precise control of wellbore pressure by manipulation of the choke settings of the choke manifold (not shown) and the corresponding application of surface backpressure. If the driller wishes to increase wellbore pressure, one or more chokes (not shown) of the choke manifold (not shown) may be closed somewhat more than their last setting to further restrict fluid flow and apply additional surface backpressure. Similarly, if the driller wishes to decrease wellbore pressure, one or more chokes (not shown) of the choke manifold (not shown) may be opened somewhat more than their last setting to increase fluid flow and reduce the amount of surface backpressure applied.

Figure 2A:
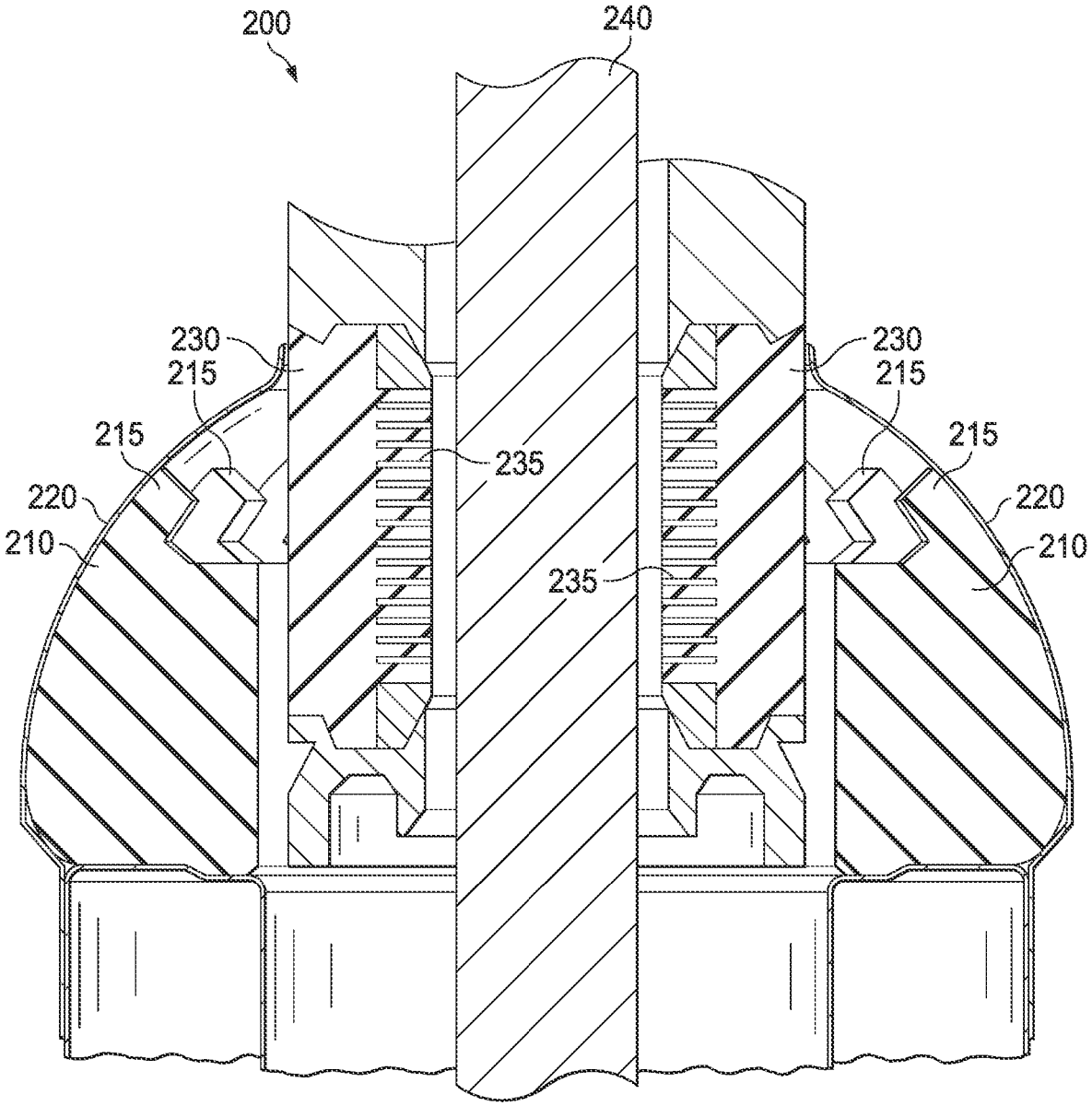
FIG. 2A PRIOR ART
FIG. 2A shows a cross-sectional view of an annular packer system of a conventional ACD-type annular sealing system in a disengaged state.
Figure 2B:
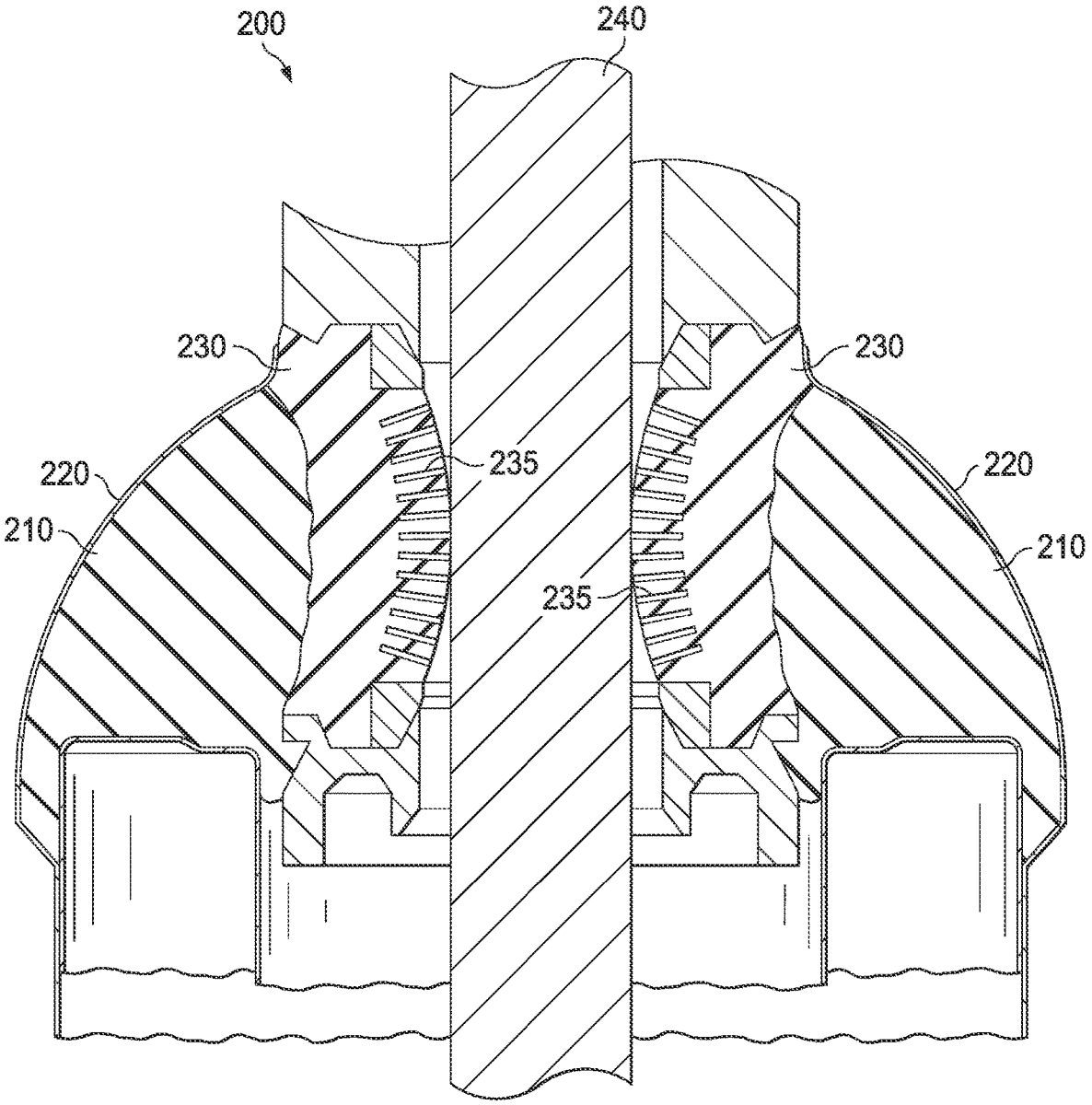
FIG. 2B PRIOR ART
FIG. 2B shows a cross-sectional view of the annular packer system of the conventional ACD-type annular sealing system in an engaged state.

FIG. 2A shows a cross-sectional view of an annular packer system 200 of a conventional ACD-type annular sealing system (e.g., 110 of FIG. 1) in a disengaged state. Annular packer system 200 includes a piston-actuated (not shown) annular packer 210 disposed within a radiused housing 220. Annular packer 210 comprises an elastomer or rubber body with a plurality of fingers or protrusions 215 that travel within housing 220 when actuated. Sealing element 230 comprises a urethane matrix co-molded with a PTFE cage 235 that receives drill pipe 240 therethrough. Sealing element 230 is disposed on a distal end of a mandrel (not shown) and another sealing element 230 (not shown) is disposed on the opposing distal end of the mandrel (not shown), typically referred to collectively as a dual seal sleeve, for use in a conventional ACD-type annular sealing system (e.g., 110 of FIG. 1). Continuing, FIG. 2B shows a cross-sectional view of annular packer system 200 of the conventional ACD-type annular sealing system (e.g., 110 of FIG. 1) in an engaged state. When hydraulically actuated, a piston (not shown) causes the elastomer or rubber portion of packer 210 to travel within housing 220 such that packer 210 and fingers 215 come in contact with sealing element 230. When packer 210 is sufficiently actuated, sealing element 230 squeezes drill pipe 240 resulting in a pressure tight seal surrounding drill pipe 240. Sealing element 230 remains stationary while drill pipe 240 rotates. Conventional ACD-type annular sealing systems (e.g., 110 of FIG. 1) typically includes two annular packer systems 200 and the dual seal sleeve (not shown) disposed therein that provides the redundant seal previously discussed. The sealing elements 230 of the dual seal sleeve are typically engaged or disengaged at the same time and are typically installed, removed, or replaced at the same time.

While not shown, one of ordinary skill in the art will recognize that RCD-type annular sealing systems (not shown) typically include an upper sealing element (not shown) and a lower sealing element (not shown) that seal the annulus surrounding drill pipe 240, however, the dual sealing elements (not shown) rotate with drill pipe 240 while maintaining the pressure tight seal. Like ACD-type annular sealing systems (e.g., 110 of FIG. 1), the redundant sealing elements (not shown) of the RCD-type annular sealing system (not shown) are typically engaged or disengaged at the same time and are typically installed, removed, or replaced at the same time.

Figure 3A:
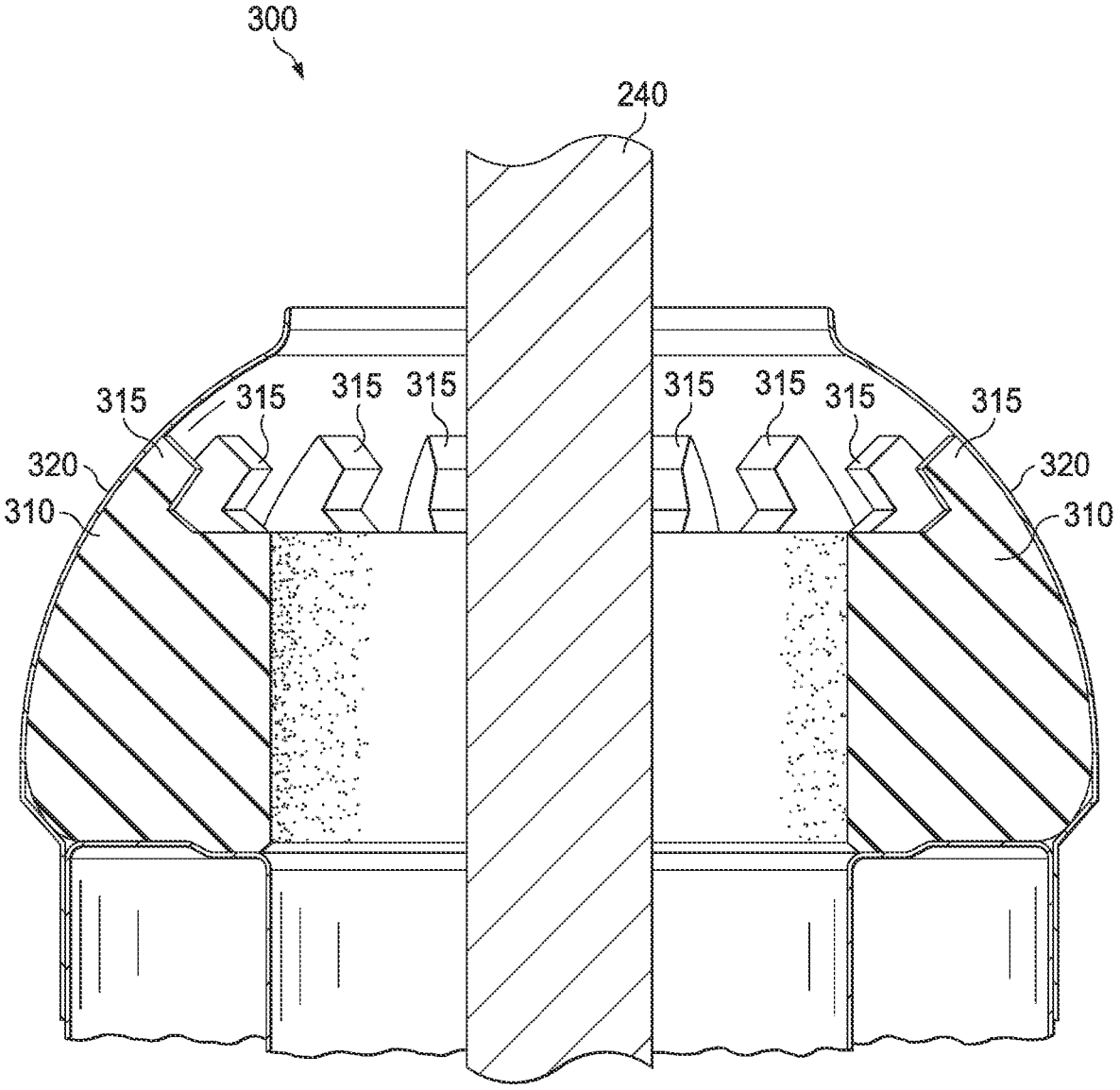
FIG. 3A PRIOR ART
FIG. 3A shows a cross-sectional view of an annular packer system of a drill string isolation tool in a disengaged state.
Figure 3B:
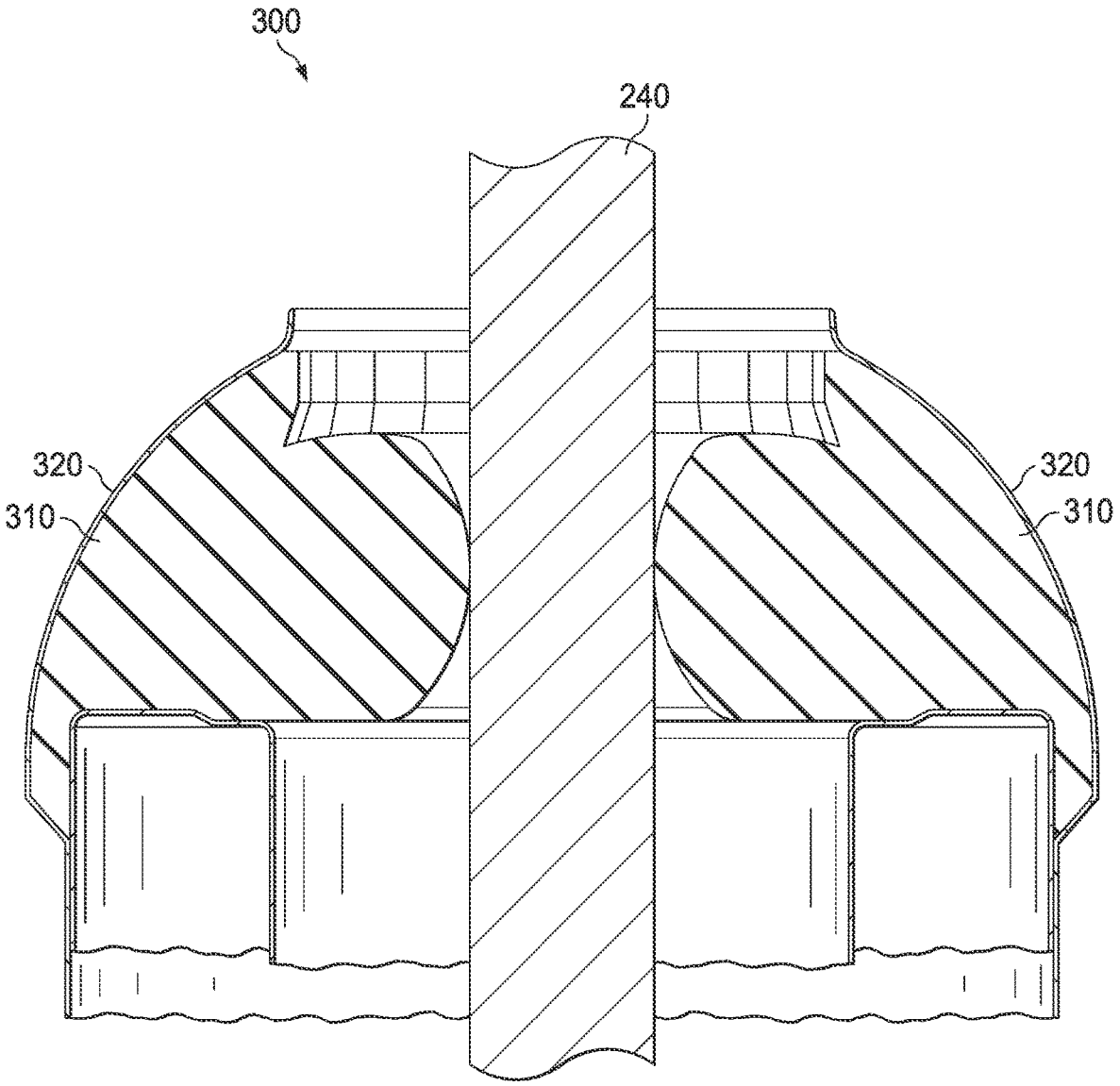
FIG. 3B PRIOR ART
FIG. 3B shows a cross-sectional view of the annular packer system of the drill string isolation tool in an engaged state.

FIG. 3A shows a cross-sectional view of an annular packer system 300 of a drill string isolation tool 120 in a disengaged state. Annular packer system 300 includes a piston-actuated (not shown) annular packer 310 disposed within a radiused housing 320. Annular packer 310 includes an elastomer or rubber body with a plurality of fingers or protrusions 315 that travel within housing 320 when actuated. In contrast to the annular packer system (e.g., 200 of FIG. 2) of the annular sealing system (e.g., 110 of FIG. 1), annular packer system 300 of drill string isolation tool 120 includes an annular packer 310 that receives drill pipe 240 therethrough and annular packer 310 itself serves as the sealing element when sufficiently engaged, however, only for comparatively shorter periods of time. Continuing, FIG. 3B shows a cross-sectional view of annular packer system 300 of drill string isolation tool 120 in an engaged state. During conventional MPD drilling operations, the dual sealing elements (e.g., 230 of FIG. 2) of the annular sealing system (e.g., 110 of FIG. 1) seal the annulus surrounding drill pipe 240 as drill pipe 240 rotates and drill string isolation tool 120 is typically disengaged during such operations. However, when the annular sealing system (e.g., 110 of FIG. 1), or components thereof, require service or replacement, drill string isolation tool 120 is engaged to maintain annular pressure. When hydraulically actuated, a piston (not shown) causes the elastomer or rubber portion of packer 310 to travel within housing 320 such that packer 310 and fingers 315 come in contact with drill pipe 240. When packer 310 is sufficiently actuated, packer 310 squeezes drill pipe 240 resulting in a pressure tight seal surrounding drill pipe 240. Once the annular sealing system (e.g., 110 of FIG. 1) is brought back online, annular packer system 300 of drill string isolation tool 120 is once again disengaged.

Figure 4:
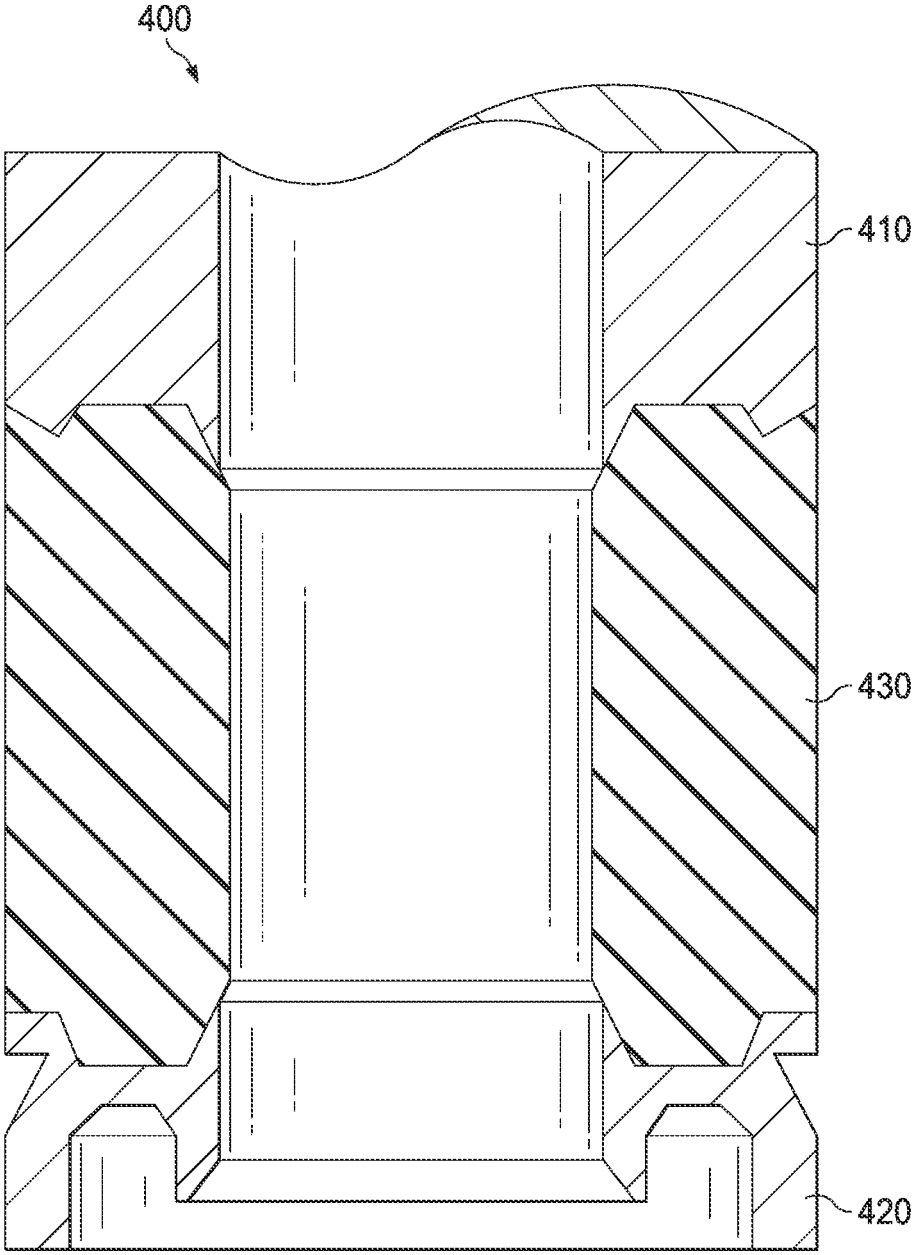
FIG. 4 shows a harsh environment connection sealing element in accordance with one or more embodiments of the present invention.

FIG. 4 shows a harsh environment connection sealing element 430 in accordance with one or more embodiments of the present invention. A bottom distal end of top mandrel 410 may be attached to a top distal end of connection sealing element 430. A top distal end of bottom mandrel 420 may be attached to a bottom distal end of connection sealing element 430. Mandrels 410 and 420 may be used to position and secure connection sealing element 430 within an annular packer (not shown). In certain embodiments, sealing element 430 may comprise an elastomer, polyurethane, nitrile butadiene, or combinations thereof. In other embodiments, sealing element 430 may consist of an elastomer, polyurethane, nitrile butadiene, or combinations thereof. One of ordinary skill in the art, having the benefit of this disclosure, will recognize that a sealing element 430 having a high resiliency, high load bearing capacity, high impact resistance, high abrasion resistance, and/or high tear resistance may be advantageous in harsh environments during stripping connections as discussed in more detail herein.

Figure 5A:
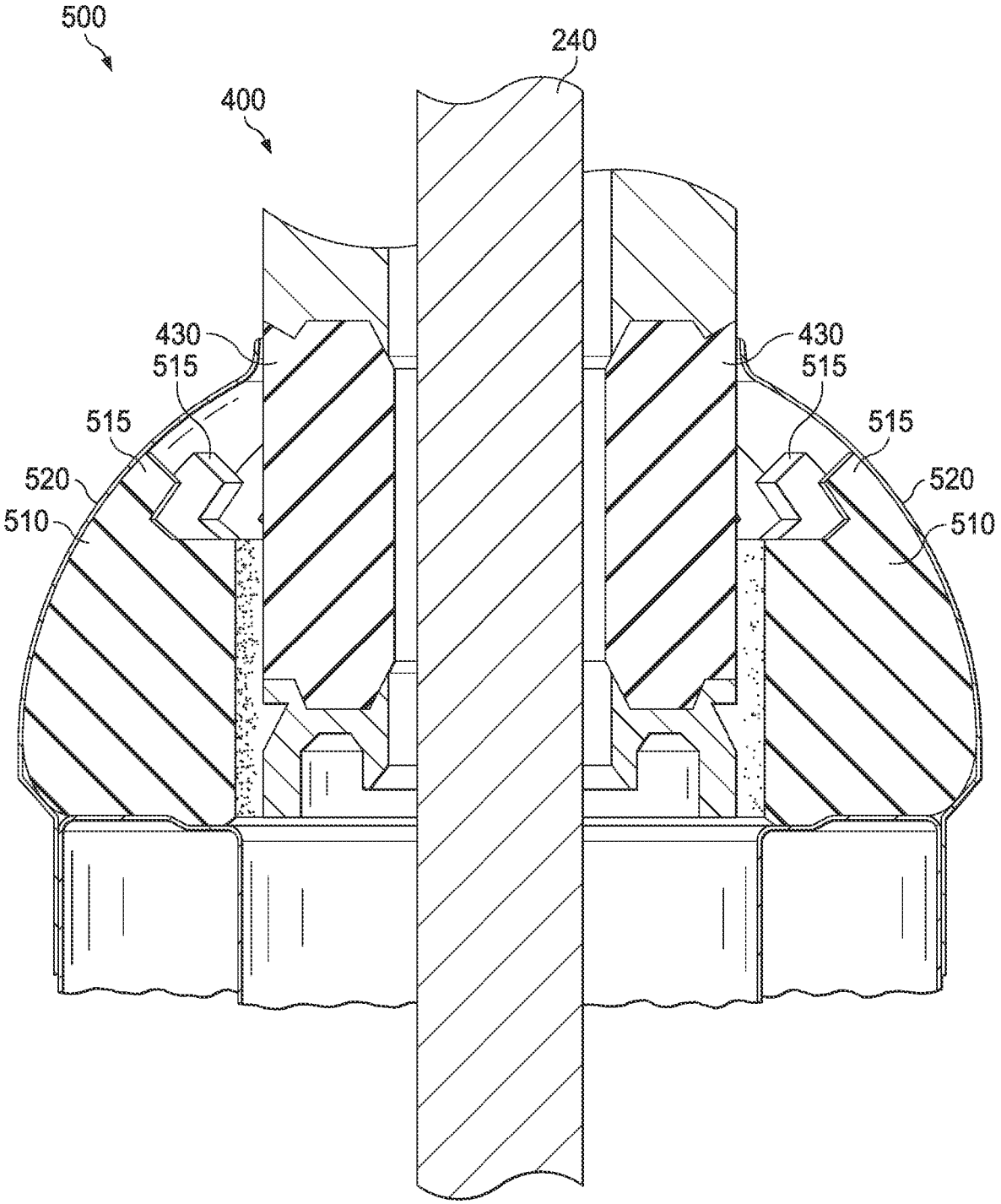
FIG. 5A shows a cross-sectional view of a harsh environment annular packer system in a disengaged state in accordance with one or more embodiments of the present invention.
Figure 5B:
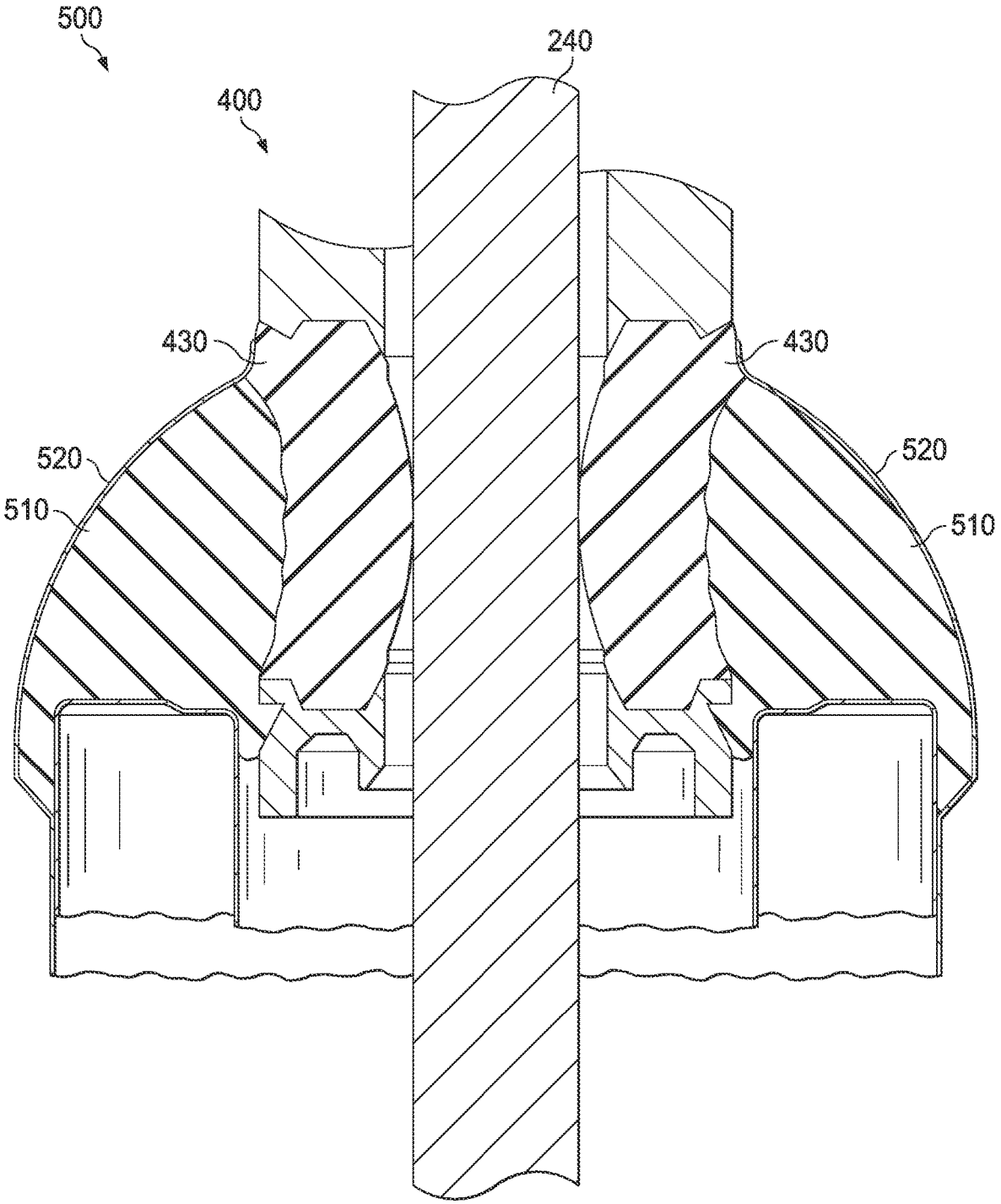
FIG. 5B shows a cross-sectional view of the harsh environment annular packer system in an engaged state in accordance with one or more embodiments of the present invention.

FIG. 5A shows a cross-sectional view of a harsh environment annular packer system 500 in a disengaged state in accordance with one or more embodiments of the present invention. Annular packer system 500 includes a piston-actuated (not shown) annular packer 510 disposed within a radiused housing 520. Annular packer 510 comprises an elastomer or rubber body with a plurality of fingers or protrusions 515 that travel within housing 520 when actuated. Connection sealing element 430 of connection seal sleeve 400 comprises an inner diameter to receive drill pipe 240 therethrough with a loose or little to no contact fit when disengaged. Continuing, FIG. 5B shows a cross-sectional view of the harsh environment annular packer system 500 in an engaged state in accordance with one or more embodiments of the present invention. When hydraulically actuated, a piston (not shown) causes the elastomer or rubber portion of packer 510 to travel within housing 520 such that packer 510 and fingers 515 come in contact with connection sealing element 430. When packer 510 is sufficiently actuated, connection sealing element 430 squeezes drill pipe 240 resulting in a pressure tight seal surrounding drill pipe 240. Connection sealing element 430 remains stationary while drill pipe 240 rotates.

Figure 6:
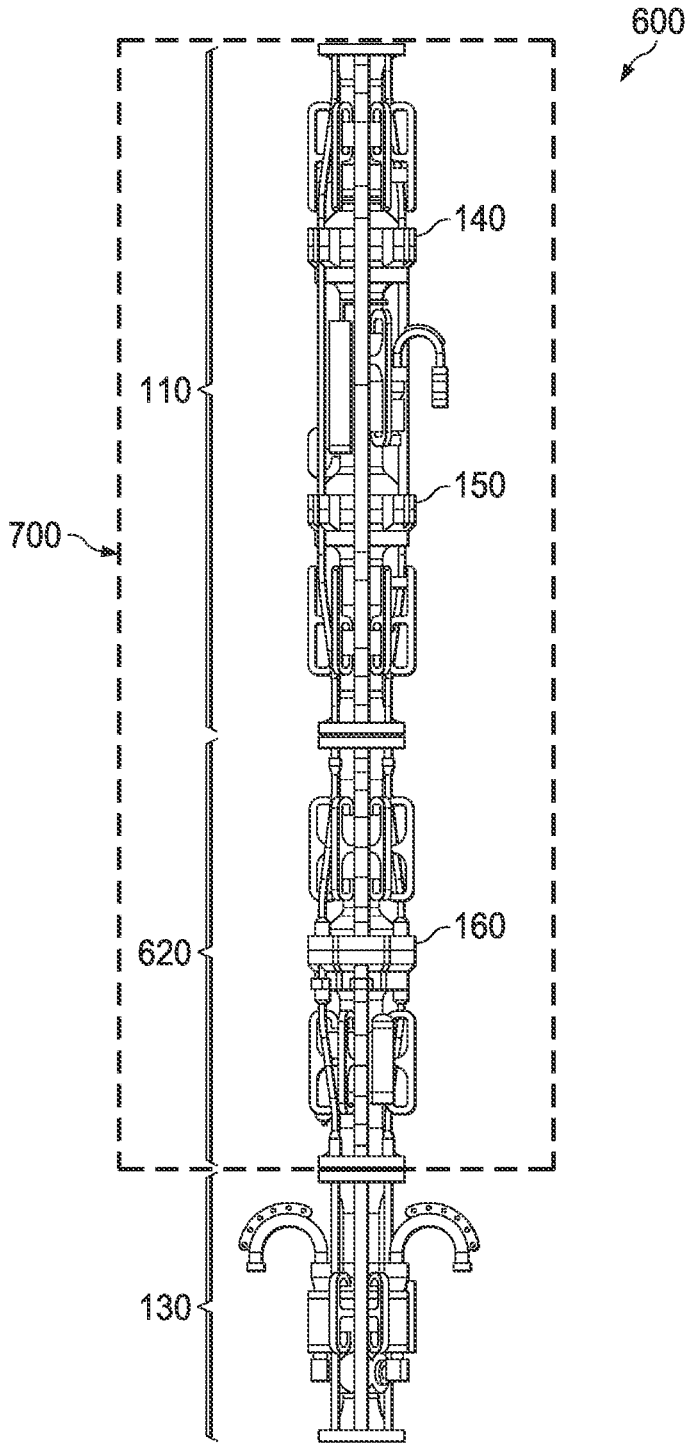
FIG. 6 shows a harsh environment integrated MPD riser joint in accordance with one or more embodiments of the present invention.

FIG. 6 shows a harsh environment integrated MPD riser joint 600 in accordance with one or more embodiments of the present invention. In certain embodiments, a harsh environment integrated MPD riser joint 600 may include a dynamic annular sealing system 110, a static annular sealing system 620 disposed directly below the dynamic annular sealing system 110, and a flow spool 130, or equivalent thereof, disposed directly below the static annular sealing system 620. Harsh environment integrated MPD riser joint 600 may be disposed below a bottom distal end of the outer barrel (not shown) of the telescopic joint (not shown) of the marine riser system (not shown) in, for example, a below-tension-ring configuration. Dynamic annular sealing system 110 may seal the annulus surrounding the drill pipe (not shown) during drilling operations while the static annular sealing system 620 is disengaged. However, during connection operations, static annular sealing system 620 may seal the annulus surrounding the drill pipe (not shown) while the dynamic annular sealing system 110 is disengaged.

Dynamic annular sealing system 110 may be a conventional ACD-type, RCD-type (not shown), or other type or kind of annular sealing system (not shown) that seals the annulus (not shown) surrounding the drill pipe (not shown) during drilling operations or other times when the drill pipe (not shown) is rotating. In the ACD-type embodiment depicted, dynamic annular sealing system 110 may include an upper sealing element 140 (not shown, reference numeral depicting general location only) and a lower sealing element 150 (not shown, reference numeral depicting general location only) that seal the annulus surrounding the drill pipe (not shown). Upper sealing element 140 (not shown, reference numeral depicting general location only) and lower sealing element 150 (not shown, reference numeral depicting general location only) may be attached to opposing ends of a mandrel (not shown) and collectively referred to herein as a dual seal sleeve. However, in certain embodiments, the connection sealing elements (e.g., 430 of FIG. 4) may be disposed on independent mandrels (not shown). The sealing elements (not shown) of the dual seal sleeve are typically engaged or disengaged at the same time. The redundant sealing mechanism extends the life of the sealing elements and increases the safety of operations.

In certain embodiments, static annular sealing system 620 may be a modified drill string isolation tool (e.g., 120 of FIG. 1), or equivalent thereof, that is disposed directly below the dynamic annular sealing system 110. In contrast to the drill string isolation tool (e.g., 120 of FIG. 1), static annular sealing system 620 may include a plurality of locking dogs disposed above the annular packer system (not independently shown) and a plurality of locking dogs disposed below the annular packer system (not shown) that position and secure a connection seal sleeve (e.g., 400 of FIG. 4) within the annular packer system (not shown).

In certain embodiments, the connection sealing element (e.g., 430 of FIG. 4) may comprise an elastomer, polyurethane, nitrile butadiene, or combinations thereof. In other embodiments, connection sealing element (e.g., 430 of FIG. 4) may consist of an elastomer, polyurethane, nitrile butadiene, or combinations thereof. While such material compositions have previously been tested for use as sealing elements in dynamic annular sealing systems (e.g., 110), they have proven ineffective due to excessive wear when the drill pipe (not shown) is rotating and typically have a useable life of mere hours. Notwithstanding, such material compositions, when used in a static annular sealing system 620, are capable of withstanding violent stripping caused by jarring heaving action and more than ten times the number of tool joints (not shown) may be passed than a conventional sealing element (e.g., 230 of FIG. 2) used with a dynamic annular sealing system 110 could withstand. In addition, an annular packer (not shown) of the annular packer system (not shown) of static annular sealing system 620 may be modified for connection operations, where the drill pipe does not rotate and jarring heaving action causes tool joints to be violently stripped through the connection seal sleeve (e.g., 400 of FIG. 4) while the connection sealing element (e.g., 430 of FIG. 4) is engaged. For example, a size, shape, and composition of the connection sealing element (e.g., 430 of FIG. 4) and a size and shape of annular packer system 500 may vary based on an application or design in accordance with one or more embodiments of the present invention.

Flow spool 130, or equivalents thereof, may be disposed directly below static annular sealing system 620 and, as part of the pressurized fluid return system, may divert fluids (not shown) from below the annular seal to the surface (not shown). Flow spool 130 may be in fluid communication with a choke manifold (not shown), typically disposed on a platform of the floating rig (not shown), that is in fluid communication with a mud-gas separator or other fluids processing system (not shown) disposed on the surface. The pressure tight seal on the annulus provided by the dynamic annular sealing system 110 during drilling operations and the static annular sealing system 620 during connection operations allows for the precise control of wellbore pressure by manipulation of the choke settings of the choke manifold (not shown) and the corresponding application of surface backpressure despite the harsh environment in which it is disposed. Advantageously, static annular sealing system 620 alone may be engaged during connection operations while the dynamic annular sealing system 110 is disengaged. Static annular sealing system 620 may be capable of withstanding the jarring having action of the harsh environment that causes a large number of tool joints to be stripped through static annular sealing system 620 while dynamic annular sealing system 110 is disengaged.

Figure 7A:
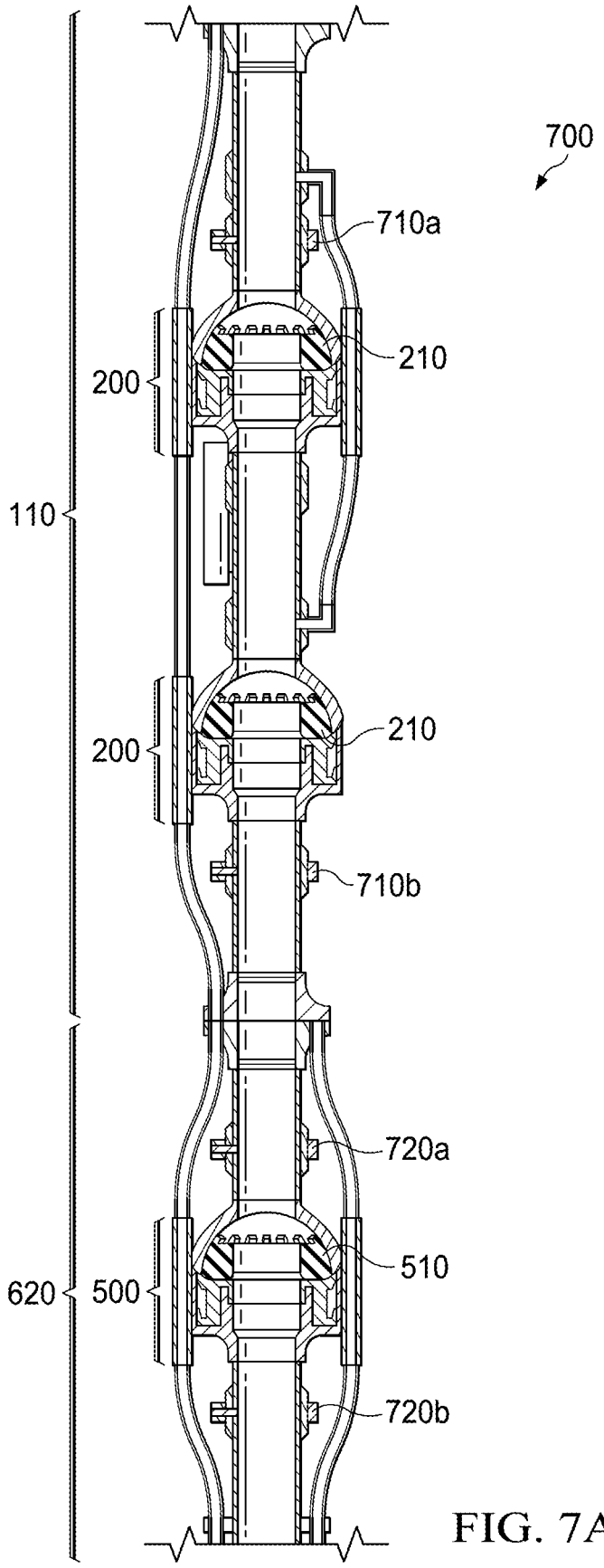
FIG. 7A shows a cross-sectional view of a dynamic annular sealing system and a static annular sealing system of a harsh environment integrated MPD riser joint in accordance with one or more embodiments of the present invention.

FIG. 7A shows a cross-sectional view of a dynamic annular sealing system 110 and a static annular sealing system 620 of a harsh environment integrated MPD riser joint 600 in accordance with one or more embodiments of the present invention. Dynamic annular sealing system 110 may include an upper annular packer system 200*a* and a lower annular packer system 200*b* to engage an upper sealing element (e.g., 230 of FIG. 2) and a lower sealing element (e.g., 230 of FIG. 2) respectively. A plurality of locking dogs 710*a* may be disposed above the upper annular packer system 200*a* and a plurality of locking dogs 710*b* may be disposed below the lower annular packer system 200*b*. A dual seal sleeve (not shown) may include an upper sealing element (e.g., 230 of FIG. 2) and a lower sealing element (e.g., 230 of FIG. 2) disposed on opposing ends of a mandrel (not shown). However, the sealing elements (e.g., 230 of FIG. 2) may be disposed on independent mandrels (not shown). The plurality of locking dogs 710*a* and 710*b* may be used to position and secure the dual seal sleeve (not shown) in place such that the sealing elements (e.g., 230 of FIG. 2) are properly positioned and secured in place with respect to upper annular packer system 200*a* and lower annular packer system 200*b*. In certain embodiments, static annular sealing system 620 may include an annular packer system 500. A plurality of locking dogs 720*a* may be disposed above the annular packer system 500. A plurality of locking dogs 720*b* may be disposed below the annular packer system 500. A connection sealing element (e.g., 430 of FIG. 4), that includes a top mandrel (not shown) and a lower mandrel (not shown) attached to opposing distal ends of the connection sealing element (e.g., 430 of FIG. 4), may be disposed within annular packer system 500. The plurality of locking dogs 720*a* and 720*b* may be used to secure the connection sealing element (e.g., 430 of FIG. 4) in place such that the connection sealing element (e.g., 430 of FIG. 4) is secured in place and properly positioned with respect to the annular packer system 500.

Figure 7B:
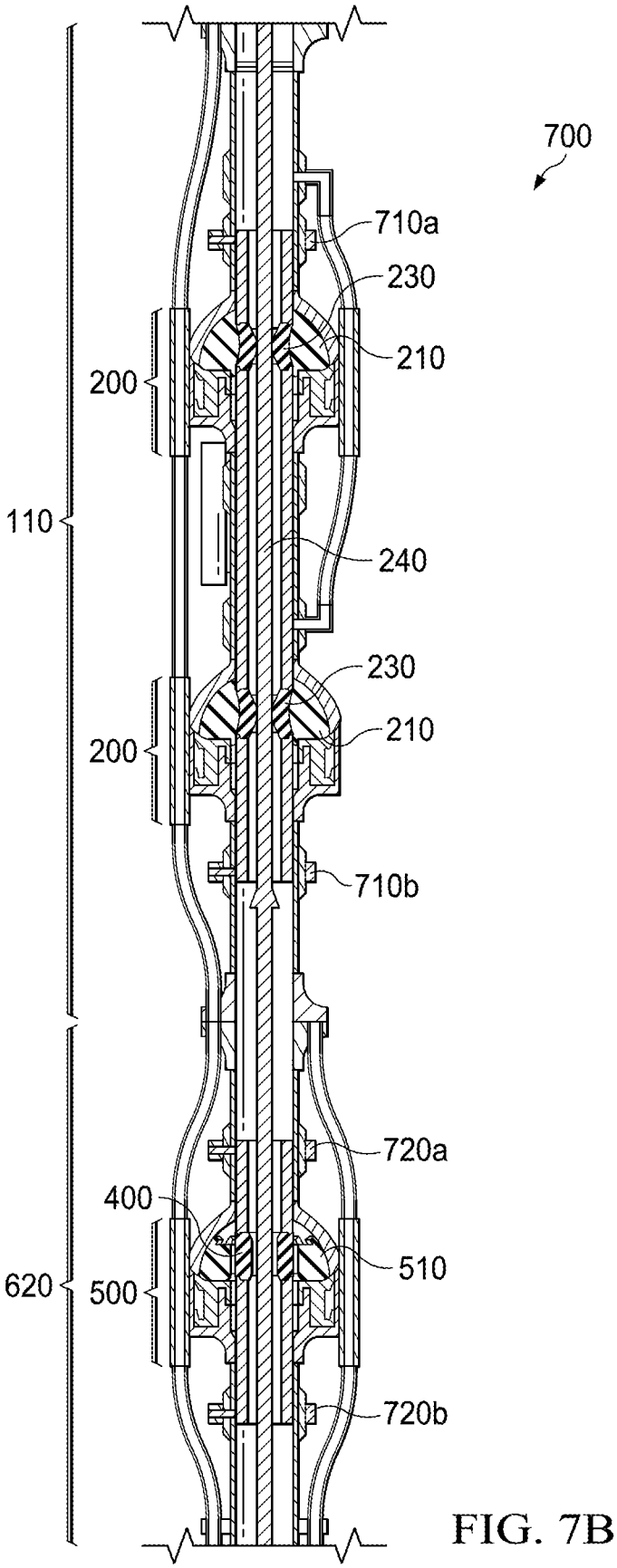
FIG. 7B shows a cross-sectional view of the dynamic annular sealing system and the static annular sealing system of the harsh environment integrated MPD riser joint configured for drilling operations in accordance with one or more embodiments of the present invention.
Figure 7C:
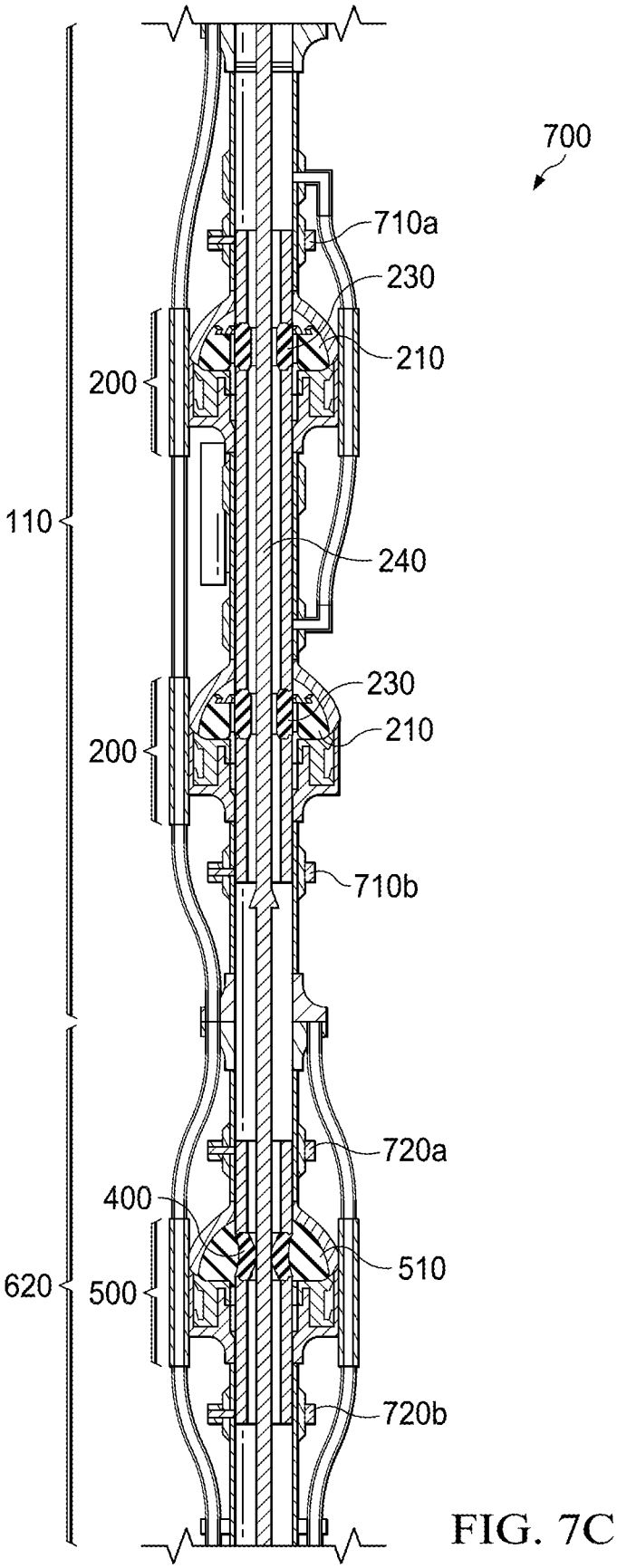
FIG. 7C shows a cross-sectional view of the dynamic annular sealing system and the static annular sealing system of the harsh environment integrated MPD riser joint configured for connection operations in accordance with one or more embodiments of the present invention.

Continuing, FIG. 7B shows a cross-sectional view of the dynamic annular sealing system 110 and the static annular sealing system 620 of the harsh environment integrated MPD riser joint 600 configured for drilling operations in accordance with one or more embodiments of the present invention. Dynamic annular sealing system 110 may maintain annular pressure, by sealing the annulus surrounding drill pipe 240, during drilling operations while the static annular sealing system 620 is disengaged, such that annular packer 510 is relaxed and connection sealing element 430 is not contacting drill pipe 240. Continuing, FIG. 7C shows a cross-sectional view of the dynamic annular sealing system 110 and the static annular sealing system 620 of the harsh environment integrated MPD riser joint 600 configured for connection operations in accordance with one or more embodiments of the present invention. Static annular sealing system 620 may be engaged such that annular packer 510 squeezes on drill pipe 240 and maintains annular pressure during connection operations. Because of the design of annular packer system 500 and the design and material composition of connection sealing element 430, static annular sealing system 620 may maintain annular pressure despite the jarring heaving action of tool joints being stripped through connection sealing element 430. Through the mutually exclusive action of dynamic annular sealing system 110 maintaining annular pressure during drilling operations and static annular sealing system 620 maintaining annular pressure during connection operations, harsh environment integrated MPD riser joint 600 may be used in harsh conditions without premature wear of sealing elements or loss of functionality and allow for continuous safe operation.

In one or more embodiments of the present invention, to transition from drilling operations to connection operations, the drill bit (not shown) may be picked up off of the bottom of the hole (not shown), applied surface backpressure may be increased to connection pressure, and the static annular sealing system 620 may be engaged to seal the annulus surrounding the drill string (not shown). The dynamic annular sealing system 110 may be disengaged and then AHC may be disengaged. Drill pipe (not shown) may be set in slips (not shown), allowing the telescopic joints (not shown) to strip through the static annular sealing system 620 while it holds pressure. Connections (not shown) may then be made. Once the slips (not shown) are removed, AHC may be activated once again, the dynamic annular sealing system 110 may be engaged, and the static annular sealing system 620 may be disengaged. Applied surface backpressure may be set to drill ahead pressure, the bottom may be tagged, and drilling operations may resume. One of ordinary skill in the art will recognize that other methods may be implemented to achieve the mutually exclusive use of the dynamic annular sealing system 110 and the static annular sealing system 620 of the harsh environment integrated MPD riser joint 600 for drilling operations and connection operations respectively.

Figure 8:
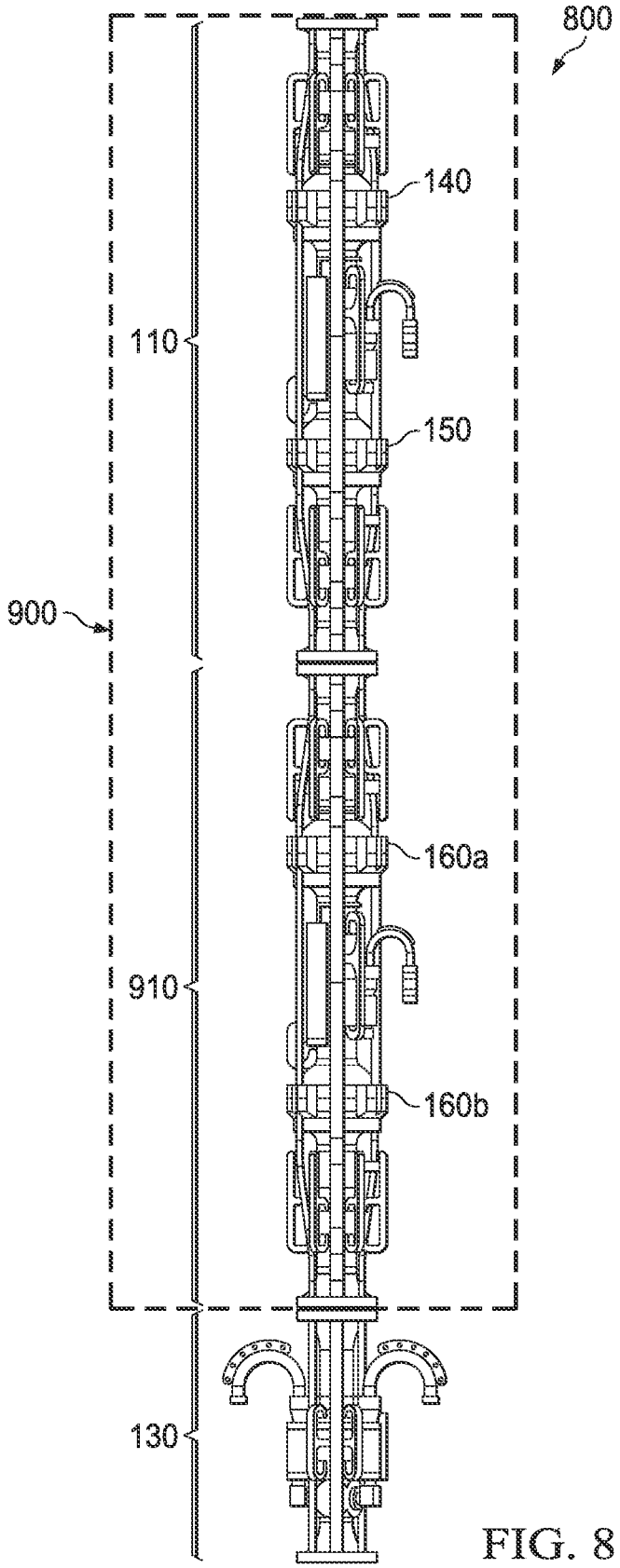
FIG. 8 shows a harsh environment integrated MPD riser joint in accordance with one or more embodiments of the present invention.

FIG. 8 shows a harsh environment integrated MPD riser joint 800 in accordance with one or more embodiments of the present invention. In certain embodiments, a harsh environment integrated MPD riser joint 800 may include a dynamic annular sealing system 110, a static annular sealing system 910 disposed directly below the dynamic annular sealing system 110, and a flow spool 130, or equivalent thereof, disposed directly below the static annular sealing system 910. Harsh environment integrated MPD riser joint 800 may be disposed below a bottom distal end of the outer barrel (not shown) of the telescopic joint (not shown) of the marine riser system (not shown) in, for example, a below-tension-ring configuration. Dynamic annular sealing system 110 may seal the annulus surrounding the drill pipe (not shown) during drilling operations while the static annular sealing system 910 is disengaged. However, during connection operations, static annular sealing system 910 may seal the annulus surrounding the drill pipe (not shown) while the dynamic annular sealing system 110 is disengaged.

Dynamic annular sealing system 110 may be a conventional ACD-type, RCD-type (not shown), or other type or kind of annular sealing system (not shown) that seals the annulus (not shown) surrounding the drill pipe (not shown) during drilling operations or other times when drill pipe (not shown) is rotating. In the ACD-type embodiment depicted, dynamic annular sealing system 110 may include an upper sealing element 140 (not shown, reference numeral depicting general location only) and a lower sealing element 150 (not shown, reference numeral depicting general location only) that seal the annulus surrounding the drill pipe (not shown). Upper sealing element 140 (not shown, reference numeral depicting general location only) and lower sealing element 150 (not shown, reference numeral depicting general location only) may be attached to opposing ends of a mandrel (not shown) and collectively referred to herein as a dual seal sleeve. However, in certain embodiments, the sealing elements (e.g., 230 of FIG. 2) may be disposed on independent mandrels (not shown). The sealing elements (e.g., 230 of FIG. 2) of the dual seal sleeve are typically engaged or disengaged at the same time. The redundant sealing mechanism extends the life of the sealing elements and increases the safety of operations.

In certain embodiments, static annular sealing system 910 may be a modified ACD-type annular sealing system (e.g., 110 of FIG. 1), or equivalent thereof, that is disposed directly below the dynamic annular sealing system 110. In contrast to the drill string isolation tool (e.g., 120 of FIG. 1) and dynamic annular sealing system 110, static annular sealing system 910 may include a plurality of locking dogs disposed above the upper annular packer system (not independently shown) and a plurality of locking dogs disposed below the upper annular packer system (not independently shown) that position and secure the upper connection sealing element (e.g., 430 of FIG. 4) within the upper annular packer system (not independently shown) and a plurality of locking dogs disposed above the lower annular packer system (not independently shown) and a plurality of locking dogs disposed below the lower annular packer system (not independently shown) that position and secure the lower connection sealing element (e.g., 430 of FIG. 4) within the lower annular packer system (not independently shown). The redundant sealing mechanism used during connection operations may extend the life of the sealing elements and increase the safety of operations.

In certain embodiments, the connection sealing elements (e.g., 430 of FIG. 4) may comprise an elastomer, polyurethane, nitrile butadiene, or combinations thereof. In other embodiments, sealing element (e.g., 430 of FIG. 4) may consist of an elastomer, polyurethane, nitrile butadiene, or combinations thereof. While such material compositions have previously been used as sealing elements in dynamic annular sealing systems (e.g., 110), they have proven unusable due to excessive wear when the drill pipe (not shown) is rotating and typically have a useable life of mere hours. Notwithstanding, such material compositions, when used in a static annular sealing system 910, are capable of withstanding violent stripping caused by jarring heaving action and more than ten times the number of tool joints (not shown) may be passed than a conventional sealing element (e.g., 230 of FIG. 2) could withstand. In addition, the annular packers (not shown) of the annular packer system (not shown) of static annular sealing system 910 may be modified for connection operations, where the drill pipe (not shown) does not rotate and jarring heaving action causes tool joints (not shown) to be violently stripped through the connection sealing elements (e.g., 430 of FIG. 4) while the connection sealing elements (e.g., 430 of FIG. 4) are engaged. For example, a size, shape, and composition of connection sealing elements (e.g., 430 of FIG. 4) and a size and shape of annular packer systems 500 may vary based on an application or design in accordance with one or more embodiments of the present invention.

Flow spool 130, or equivalents thereof, may be disposed directly below static annular sealing system 910 and, as part of the pressurized fluid return system, may divert fluids (not shown) from below the annular seal to the surface (not shown). Flow spool 130 may be in fluid communication with a choke manifold (not shown), typically disposed on a platform of the floating rig (not shown), that is in fluid communication with a mud-gas separator or other fluids processing system (not shown) disposed on the surface. The pressure tight seal on the annulus provided by the dynamic annular sealing system 110 during drilling operations and the static annular sealing system 910 during connection operations allows for the precise control of wellbore pressure by manipulation of the choke settings of the choke manifold (not shown) and the corresponding application of surface backpressure despite the harsh environment in which it is disposed. Advantageously, static annular sealing system 910 alone may be engaged during connection operations while the dynamic annular sealing system 110 is disengaged. Static annular sealing system 910 may be capable of withstanding the jarring having action of the harsh environment that causes a large number of tool joints to be stripped through static annular sealing system 910 while dynamic annular sealing system 110 is disengaged.

Figure 9A:
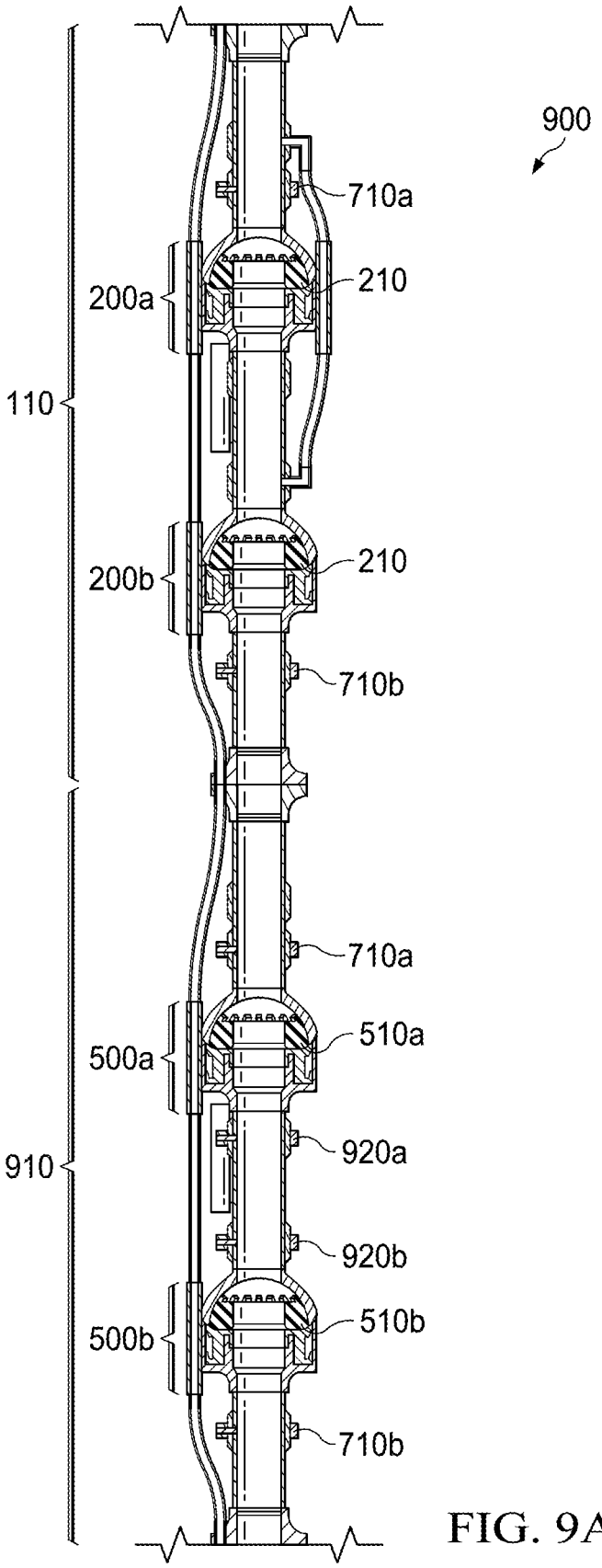
FIG. 9A shows a cross-sectional view of a dynamic annular sealing system and a static annular sealing system of a harsh environment integrated MPD riser joint in accordance with one or more embodiments of the present invention.

FIG. 9A shows a cross-sectional view of a dynamic annular sealing system 110 and a static annular sealing system 910 of a harsh environment integrated MPD riser joint 800 in accordance with one or more embodiments of the present invention. Dynamic annular sealing system 110 may include an upper annular packer system 200*a* and a lower annular packer system 200*b* to engage an upper sealing element (e.g., 230 of FIG. 2) and a lower sealing element (e.g., 230 of FIG. 2) respectively. A plurality of locking dogs 710*a* may be disposed above the upper annular packer system 200A and plurality of locking dogs 710*b* may be disposed below the lower annular packer system 200*b*. A dual seal sleeve (not shown) may include an upper sealing element (e.g., 230 of FIG. 2) and a lower sealing element (e.g., 230 of FIG. 2) disposed on opposing ends of a mandrel (not shown). However, the sealing elements (e.g., 230 of FIG. 2) may be disposed on independent mandrels (not shown). The plurality of locking dogs 710*a* and 710*b* may be used to position and secure the dual seal sleeve in place such that the sealing elements (e.g., 230 of FIG. 2) are properly positioned and secured in place with respect to upper annular packer system 200*a* and lower annular packer system 200*b*.

In certain embodiments, static annular sealing system 910 may include an upper annular packer system 500*a* and a lower annular packer system 500*b*. A plurality of locking dogs 710*a* may be disposed above the upper annular packer system 500*a* and a plurality of locking dogs 920*a* may be disposed below the upper annular packer system 500*a* to position and secure the connection sealing element (e.g., 430 of FIG. 4) in place within the upper annular packer system 500*a*. A plurality of locking dogs 920*b* may be disposed above the lower annular packer system 500*b* and a plurality of locking dogs 720*b* may be disposed below the lower annular packer system 500*b* to position and secure the connection sealing element (e.g., 430 of FIG. 4) in place within the lower annular packer system 500*b*. An upper connection sealing element (e.g., 430 of FIG. 4) may be disposed within an upper annular packer system 500*a* and a lower connection sealing element (e.g., 430 of FIG. 4) may be disposed within a lower annular packer system 500*b*. The plurality of locking dogs 710*a* and 920*a* may be used to position and secure the upper connection sealing element (e.g., 430 of FIG. 4) in place such that the upper connection sealing element (e.g., 430 of FIG. 4) is properly positioned and secured in place with respect to the upper annular packer system 500*a*. The plurality of locking dogs 920*b* and 720*b* may be used to position and secure the lower connection sealing element (e.g., 439 of FIG. 4) in place such that the lower connection sealing element (e.g., 430 of FIG. 4) is properly positioned and secured in place with respect to the lower annular packer system 500*b*.

Figure 9B:
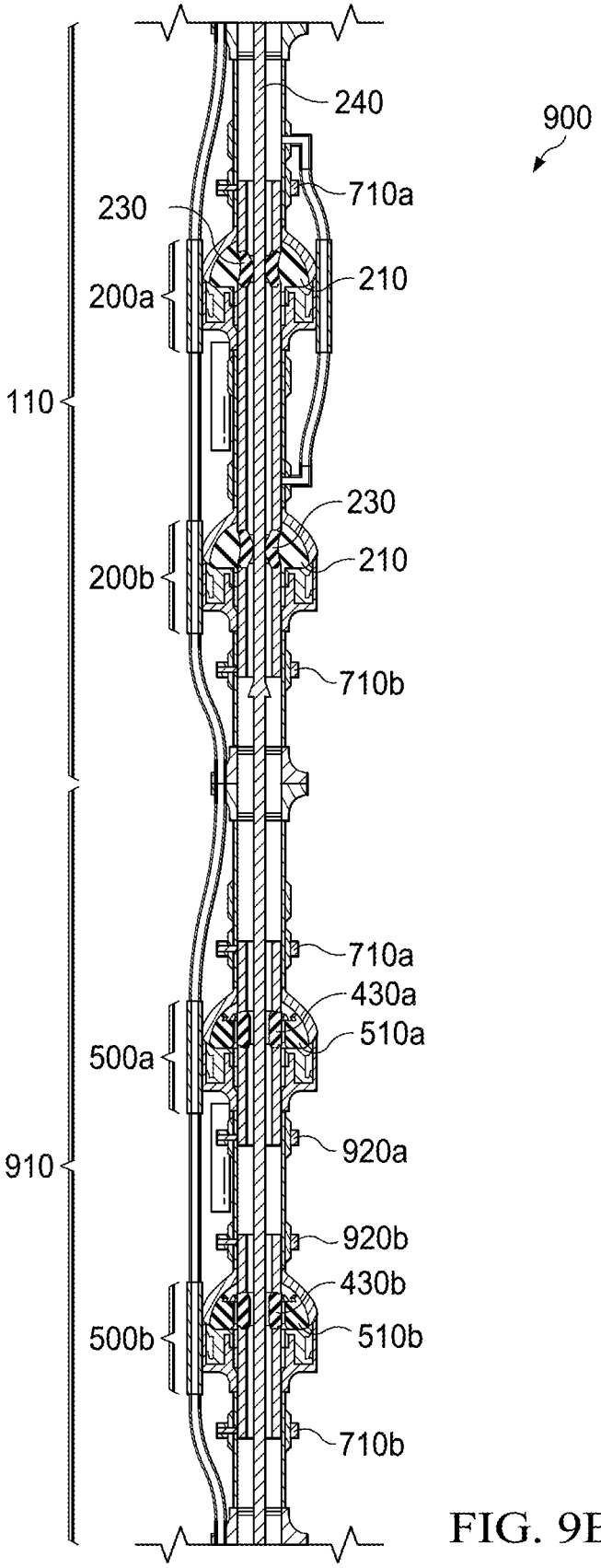
FIG. 9B shows a cross-sectional view of the dynamic annular sealing system and the static annular sealing system of the harsh environment integrated MPD riser joint configured for drilling operations in accordance with one or more embodiments of the present invention.
Figure 9C:
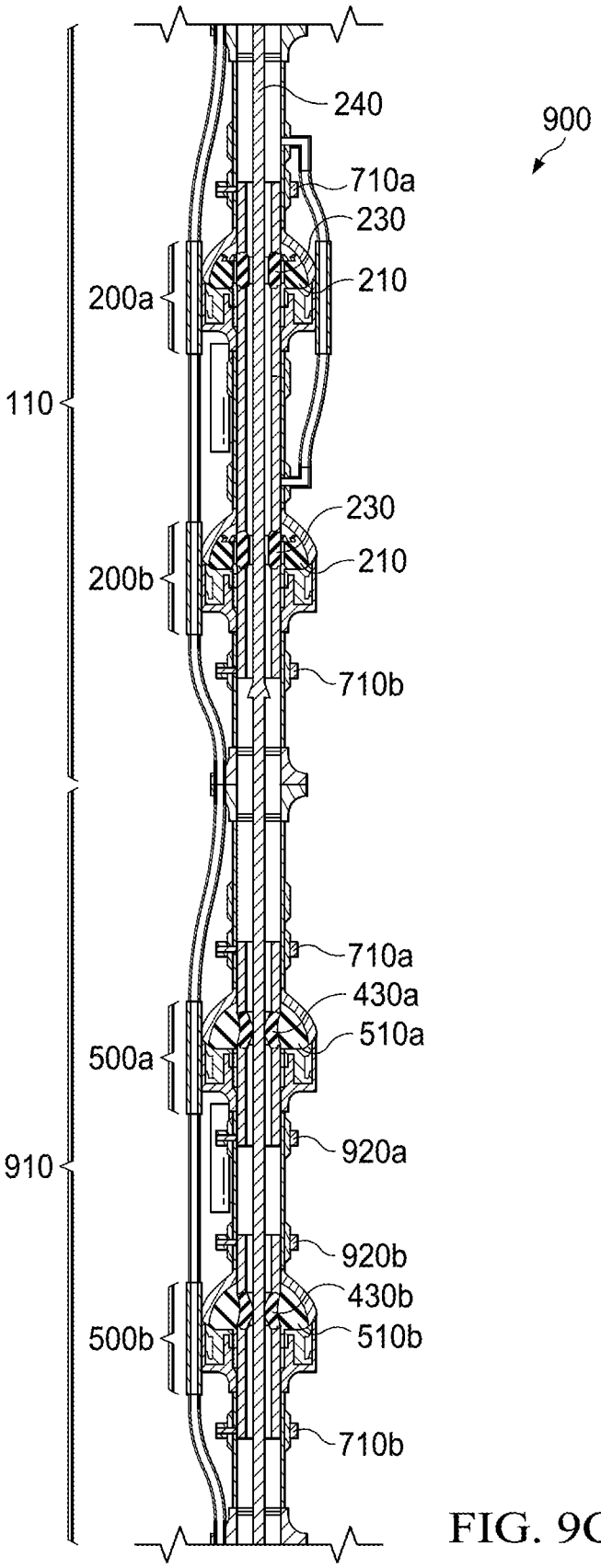
FIG. 9C shows a cross-sectional view of the dynamic annular sealing system and the static annular sealing system of the harsh environment integrated MPD riser joint configured for connection operations in accordance with one or more embodiments of the present invention.

Continuing, FIG. 9B shows a cross-sectional view of the dynamic annular sealing system 110 and the static annular sealing system 910 of the harsh environment integrated MPD riser joint 800 configured for drilling operations in accordance with one or more embodiments of the present invention. Dynamic annular sealing system 110 may maintain annular pressure, by sealing the annulus surrounding drill pipe 240, during drilling operations while the static annular sealing system 910 is disengaged, such that annular packers 510*a* and 510*b* are relaxed and connection sealing elements 430*a* and 430*b* are not contacting drill pipe 240. Continuing, FIG. 9C shows a cross-sectional view of the dynamic annular sealing system 110 and the static annular sealing system 910 of the harsh environment integrated MPD riser joint 800 configured for connection operations in accordance with one or more embodiments of the present invention. Static annular sealing system 910 may be engaged such that annular packers 510*a* and 510*b* squeeze connection sealing elements 430*a* and 430*b* on drill pipe 240 and maintain annular pressure during connection operations. Because of the design of annular packer systems 500*a* and 500*b* and the design and material composition of connection sealing elements 430*a* and 430*b*, static annular sealing system 910 may maintain annular pressure despite the jarring heaving action of tool joints being stripped through connection sealing elements 430*a* and 430*b*. Through the mutually exclusive action of dynamic annular sealing system 110 maintaining annular pressure during drilling operations and static annular sealing system 910 maintaining annular pressure during connection operations, harsh environment integrated MPD riser joint 800 may be used in harsh conditions without premature wear of sealing elements or loss of functionality and allow for continuous safe operation.

In one or more embodiments of the present invention, to transition from drilling operations to connection operations, the drill bit (not shown) may be picked up off of the bottom of the hole (not shown), applied surface backpressure may be increased to connection pressure, and the static annular sealing system 910 may be engaged to seal the annulus surrounding the drill string (not shown). The dynamic annular sealing system 110 may be disengaged and then AHC may be disengaged. Drill pipe (not shown) may be set in slips (not shown), allowing the telescopic joints (not shown) to strip through the static annular sealing system 910 while it holds pressure. Connections (not shown) may then be made. Once the slips (not shown) are removed, AHC may be activated once again, the dynamic annular sealing system 110 may be engaged, and the static annular sealing system 910 may be disengaged. Applied surface backpressure may be set to drill ahead pressure, the bottom may be tagged, and drilling operations may resume. One of ordinary skill in the art will recognize that other methods may be implemented to achieve the mutually exclusive use of the dynamic annular sealing system 110 and the static annular sealing system 910 of the harsh environment integrated MPD riser joint 800 for drilling operations and connection operations respectively.

In certain embodiments (not shown), static annular sealing system 910 may be used without connection sealing elements 430*a* or 430*b*, instead relying on the redundant sealing mechanism of the upper annular packer 510*a* and the lower annular packer 510*b* to maintain annular pressure.

In certain embodiments (not shown), a drill string isolation tool (e.g., 120 of FIG. 1) may be disposed below the static annular sealing system 620 or 910 as part of the harsh environment integrated MPD riser joint 600 or 800.

Advantages of one or more embodiments of the present invention may include, but is not limited to, one or more of the following:

In one or more embodiments of the present invention, a harsh environment integrated MPD riser joint maintains annular pressure in harsh environments where violent stripping is encountered due to jarring heaving action of the floating rig relative to the body of water in which it is disposed.

In one or more embodiments of the present invention, a harsh environment integrated MPD riser joint uses a conventional annular sealing system as a dynamic annular sealing system to maintain annular pressure during drilling operations and a novel static annular sealing system, disposed directly below the dynamic annular sealing system, to maintain annular pressure during connection operations. Advantageously, the dynamic annular sealing system is only used during drilling operations in which it is demonstrably effective and the new static annular sealing system is only used during connection operations in harsh environments where it has proven to be highly effective at maintaining pressure while violent stripping is encountered dur to jarring heaving action of the floating rig relative to the body of water in which it is disposed.

In one or more embodiments of the present invention, a harsh environment integrated MPD riser joint may use an ACD-type, RCD-type, or other-type of conventional annular sealing system as the dynamic sealing system. In certain embodiments, the static annular sealing system may be modified ACD-type sealing system that includes additional locking dogs to position and secure connection sealing elements within the annular packer systems and may include one or more proximity sensors to assist with deployment and retrieval of the connection sealing elements. In other embodiments, the static annular sealing system may be a modified drill string isolation tool that includes a modified annular packer and locking dogs to position and secure a connection sealing element within the annular packer system and may include one or more proximity sensors to assist with deployment and retrieval of the connection sealing element. In still other embodiments, static annular sealing system may be an annular sealing system that has one or more annular packer systems and one or more corresponding annular packers to engage one or more connection sealing elements configured for harsh environments.

In one or more embodiments of the present invention, a harsh environment integrated MPD riser joint provides an annular seal for an extended operational period over than of a conventional integrated MPD riser joint. Because the dynamic annular sealing system is only used during drilling operations and the static annular sealing system in only used during connections and other non-rotation operations, the proper sealing element is used for the corresponding operation and the connection sealing element(s) is capable of withstanding violent stripping encountered dur to jarring heaving action of the floating rig relative to the body of water in which it is disposed.

In one or more embodiments of the present invention, a harsh environment integrated MPD riser joint is substantially smaller in size and weighs substantially less than a conventional integrated MPD riser joint.

In one or more embodiments of the present invention, a harsh environment integrated MPD riser joint is substantially easier to deliver, install, operate, and remove than a conventional integrated MPD riser joint.

In one or more embodiments of the present invention, a harsh environment integrated MPD riser joint may be used in harsh environments, such as, for example, the North Sea, where jarring heaving is often encountered.

While the present invention has been described with respect to the above-noted embodiments, those skilled in the art, having the benefit of this disclosure, will recognize that other embodiments may be devised that are within the scope of the invention as disclosed herein. Accordingly, the scope of the invention should be limited only by the appended claims.

What is claimed is:

1. A harsh environment integrated MPD riser joint comprising:

a dynamic annular sealing system comprising:
an upper sealing element, and
a lower sealing element;

a static annular sealing system disposed below the dynamic annular sealing system comprising:
an annular packer system and a connection sealing element disposed within the annular packer system;

a flow spool disposed below the static annular sealing system that diverts returning fluids to the surface, wherein the dynamic annular sealing system maintains annular pressure during drilling operations while the static annular sealing system is disengaged, wherein the static annular sealing system maintains annular pressure during connection operations while the dynamic annular sealing system is disengaged, and wherein a top mandrel is attached to a top distal end of the connection sealing element and a bottom mandrel is attached to a bottom distal end of the connection sealing element and the top mandrel and bottom mandrel secure the connection sealing element in place relative to the annular packer system with a plurality of locking dogs.

2. The harsh environment integrated MPD riser joint of claim 1, wherein the annular sealing system is an ACD-type annular sealing system.

3. The harsh environment integrated MPD riser joint of claim 1, wherein the annular sealing system is an RCD-type annular sealing system.

4. The harsh environment integrated MPD riser joint of claim 1, wherein the annular sealing system is a hybrid-type annular sealing system.

5. The harsh environment integrated MPD riser joint of claim 1, wherein the connection sealing element comprises polyurethane.

6. The harsh environment integrated MPD riser joint of claim 1, wherein the connection sealing element comprises nitrile rubber.

7. The harsh environment integrated MPD riser joint of claim 1, wherein the connection sealing element comprises polyurethane and nitrile rubber.

8. The harsh environment integrated MPD riser joint of claim 1, wherein the connection sealing element consists of polyurethane.

9. The harsh environment integrated MPD riser joint of claim 1, wherein the connection sealing element consists of nitrile rubber.

10. A harsh environment integrated MPD riser joint comprising:

a dynamic annular sealing system comprising:
an upper sealing element, and
a lower sealing element;

a static annular sealing system disposed below the dynamic annular sealing system comprising:

an upper annular packer system and an upper connection sealing element disposed within the upper annular packer system, and a lower annular packer system and a lower connection sealing element disposed within the lower annular packer system;

a flow spool disposed below the static annular sealing system that diverts returning fluids to the surface, wherein the dynamic annular sealing system maintains annular pressure during drilling operations while the static annular sealing system is disengaged, wherein the static annular sealing system maintains annular pressure during connection operations while the dynamic annular sealing system is disengaged, and wherein a top mandrel is attached to a top distal end of the upper connection sealing element and a bottom mandrel is attached to a bottom distal end of the upper connection sealing element and the top mandrel and bottom mandrel secure the upper connection sealing element in place relative to the upper annular packer system with a plurality of locking dogs.

11. The harsh environment integrated MPD riser joint of claim 10, wherein the dynamic annular sealing system is an ACD-type annular sealing system.

12. The harsh environment integrated MPD riser joint of claim 10, wherein the dynamic annular sealing system is an RCD-type annular sealing system.

13. The harsh environment integrated MPD riser joint of claim 10, wherein the dynamic annular sealing system is a hybrid-type annular sealing system.

14. The harsh environment integrated MPD riser joint of claim 10, wherein the upper and lower connection sealing elements comprise polyurethane.

15. The harsh environment integrated MPD riser joint of claim 10, wherein the upper and lower connection sealing elements comprise nitrile rubber.

16. The harsh environment integrated MPD riser joint of claim 10, wherein the upper and lower connection sealing elements comprise polyurethane and nitrile rubber.

17. The harsh environment integrated MPD riser joint of claim 10, wherein the upper and lower connection sealing elements consist of polyurethane.

18. The harsh environment integrated MPD riser joint of claim 10, wherein the upper and lower connection sealing elements consist of nitrile rubber.

19. The harsh environment integrated MPD riser joint of claim 10, wherein a top mandrel is attached to a top distal end of the lower connection sealing element and a bottom mandrel is attached to a bottom distal end of the lower connection sealing element and the top mandrel and bottom mandrel are to secure the lower connection sealing element in place relative to the upper annular packer system with a plurality of locking dogs.

* * * * *